US007643763B2

(12) United States Patent
Kawakami

(10) Patent No.: US 7,643,763 B2
(45) Date of Patent: Jan. 5, 2010

(54) IMAGE FORMING APPARATUS HAVING A DENSITY COUNTING UNIT

(75) Inventor: Takahiro Kawakami, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 622 days.

(21) Appl. No.: 11/421,092

(22) Filed: May 31, 2006

(65) Prior Publication Data

US 2006/0275044 A1 Dec. 7, 2006

(30) Foreign Application Priority Data

Jun. 2, 2005 (JP) ..... 2005-163322

(51) Int. Cl.
*G03G 15/08* (2006.01)

(52) U.S. Cl. ..... 399/27

(58) Field of Classification Search ..... 399/27, 399/28

See application file for complete search history.

(56) References Cited

U.S. PATENT DOCUMENTS 6,167,214 A * 12/2000 Scheuer et al. ..... 399/27

FOREIGN PATENT DOCUMENTS

JP 04-261566 9/1992

* cited by examiner

*Primary Examiner*—David M Gray
*Assistant Examiner*—Ruth N Labombard
(74) *Attorney, Agent, or Firm*—Renner, Otto, Boisselle & Sklar, LLP

(57) ABSTRACT

A density counting unit of an image forming apparatus for forming a monochromatic image or a color image represented by a plurality of color components on a photosensitive member includes: first totaling means for totaling pixel values of monochromatic component of each pixel of an image when a monochromatic image is formed; second totaling means for totaling pixel values of monochromatic component of each pixel of an image when a monochromatic image is formed, and totaling pixel values of predetermined color component when a color image is formed; and third totaling means for totaling pixel values of color components other than the predetermined color component when a color image is formed. When a monochromatic image is formed, the first totaling means and the second totaling means total the pixel values of the odd number lines and the even number lines, respectively.

9 Claims, 25 Drawing Sheets

IMAGE FORMING APPARATUS HAVING A DENSITY COUNTING UNIT

CROSS-REFERENCE TO RELATED APPLICATIONS

This Non-provisional application claims priority under 35 U.S.C. §119(a) on Patent Application No. 2005-163322 filed in Japan on Jun. 2, 2005, the entire contents of which are hereby incorporated by reference.

BACKGROUND OF THE INVENTION

1. Field of the Invention

The present invention relates to an image forming apparatus, and more specifically to an image forming apparatus for forming on a photosensitive member a monochromatic image or a color image represented by a plurality of color components.

2. Description of Related Art

Among copying machines and multi function printers (MFPs) having a copying function using a conventional image forming apparatus, a type capable of measuring a toner consumption is known (for example, see Japanese Patent Application Laid-Open No. 4-261566 (1992)). In such a type of multi function printer, by measuring the toner consumption, it becomes possible to charge in accordance with the toner consumption and perform maintenance based on the toner consumption. The toner consumption can be calculated, for example, based on the cumulative value by totaling pixel values (density values) of pixels of an image formed on a photosensitive member.

Recently there have become popular copying machines or multi function printers utilizing an image forming apparatus capable of performing color printing. When performing color printing utilizing an image forming apparatus, for example, laser beam is irradiated from laser diodes corresponding to respective C (Cyan), M (Magenta), Y (Yellow), K (Black) onto a photosensitive member corresponding to respective C, M, Y, K, whereby electrostatic latent images of color components are formed, and images obtained by developing the electrostatic latent images with toners of colors corresponding thereto are once formed on the photosensitive member. Thereafter, images for each color are registered and transferred from the photosensitive member onto a sheet. There has been also known an image forming apparatus in which, for example, two laser diodes for black are provided, so that the separate diodes form an odd number line (K1) and an even number line (K2), respectively, in order to achieve a high-speed monochrome printing.

FIG. 1 is a block diagram showing a conventional configuration example of a density counting unit for totaling pixel values (density values) of an image formed on a photosensitive member. Further, FIG. 1 shows a case where laser diodes corresponding to respective C, M, Y, K1, K2 are used in order to achieve a high-speed monochromatic printing by way of example. Therefore, a density counting unit 2 includes density counters 2C, 2M, 2Y, 2K1, 2K2 for totaling pixel values (density values) of color components of C, M, Y, K1, K2, respectively.

As shown in FIG. 1, when two laser diodes are used for black, a rate of image formation is improved, while two density counters are required to be provided for black. Hence, problems occur such as an enlarged circuit scale, an increased power consumption and a remarkably risen manufacturing cost.

BRIEF SUMMARY OF THE INVENTION

The present invention is made in view of such circumstances, and in a plain expression, has a configuration in which other than totaling means inherently provided for totaling pixel values of monochromatic components, totaling means for totaling pixel values of color components of one of C, M, Y is also used as the totaling means for totaling pixel values of monochromatic components when a monochromatic image is formed.

An object of the present invention is to provide an image forming apparatus capable of reducing the circuit scale, power consumption and manufacturing cost to perform a cumulative total processing.

Further, another object of the present invention is to provide an image forming apparatus capable of controlling the toner consumption of respective color components.

Moreover, another object of the present invention is to provide an image forming apparatus having the buffer memory capable of adjusting and eliminating any addition timing gap even if there exists a dislocation in main scanning direction between the odd number line and the even number line of a monochromatic image.

Moreover, another object of the present invention is to provide an image forming apparatus capable of reducing the circuit scale, power consumption and manufacturing cost without requiring an appending buffer memory by utilizing the inherently provided memory instead of the above-mentioned buffer memory.

Moreover, another object of the present invention is to provide an image forming apparatus in which when a processing of forming a monochromatic image and a processing of forming a color image are switched to each other, the cumulative value of the totaling means for totaling pixel values of one of color components used also as the above-mentioned totaling means for totaling pixel values of monochromatic component is not confused with the cumulative value for monochromatic components.

Moreover, another object of the present invention is to provide an image forming apparatus capable of reducing the power consumption when a monochromatic image is formed on a photosensitive member.

An image forming apparatus in accordance with the present invention is an image forming apparatus for forming on a photosensitive member a monochromatic image or a color image represented by a plurality of color components, and is characterized by comprising: first totaling means for totaling pixel values of monochromatic component of each pixel of an image formed on the photosensitive member when a monochromatic image is formed on the photosensitive member; and second totaling means for totaling pixel values of monochromatic component of each pixel of an image formed on the photosensitive member when a monochromatic image is formed on the photosensitive member, and totaling pixel values of predetermined color component of each pixel of an image formed on the photosensitive member when a color image is formed on the photosensitive member.

An image forming apparatus in accordance with the present invention is characterized by further comprising third totaling means for totaling pixel values of respective color components other than the predetermined color component of each pixel of an image formed on the photosensitive member when a color image is formed on the photosensitive member.

In the image forming apparatus in accordance with the present invention as described above, when a monochromatic image is formed on a photosensitive member, pixel values of monochromatic components of each pixel of the image formed on the photosensitive member are totaled by the first totaling means and the second totaling means. On the other hand, when a color image is formed on a photosensitive member, pixel values of predetermined color component are totaled by the second totaling means. That is, in both cases where a monochromatic image is formed on a photosensitive member, and where a color image is formed on a photosensitive member, the second totaling means is shared in use. Therefore, the circuit scale, power consumption and manufacturing cost can be reduced to perform a cumulative total processing. In addition, when a color image is formed on a photosensitive member, a configuration can be also embodied such that pixel values of predetermined color component are totaled by the second totaling means, while pixel values of respective color components other than predetermined color component are totaled by the third totaling means.

An image forming apparatus in accordance with the present invention is characterized by further comprising: first monochrome forming means for forming odd number lines of a monochromatic image on the photosensitive member; and second monochrome forming means for forming even number lines of the monochromatic image on the photosensitive member; wherein when a monochromatic image is formed on the photosensitive member, the first totaling means totals pixel values of monochromatic component of each pixel of the image formed on the photosensitive member by one of the first monochrome forming means and the second monochrome forming means, while the second totaling means totals pixel values of monochromatic components of each pixel of an image formed on the photosensitive member by the other of the first monochrome forming means and the second monochrome forming means.

In the image forming apparatus in accordance with the present invention as described above, when a monochromatic image is formed on a photosensitive member, odd number lines of the monochromatic image are formed on the photosensitive member by the first monochrome forming means, while even number lines of the same are formed on the same by the second monochrome forming means. Then, pixel values of monochromatic component of an image formed by one of the first monochrome forming means and the second monochrome forming means are totaled by the first totaling means, while pixel values of monochromatic component of an image formed by the other are totaled by the second totaling means. That is, in both cases where a monochromatic image is formed on a photosensitive member, and where a color image is formed on a photosensitive member, the second totaling means is shared in use, so that the circuit scale, power consumption and manufacturing cost can be reduced to perform a cumulative total processing.

An image forming apparatus in accordance with the present invention is characterized in that each of the first, second and third totaling means includes: a storage unit for storing cumulative value of pixel values; and adding means for adding the pixel values of corresponding color component of the image formed on the photosensitive member to the cumulative value stored in the storage unit; and toner consumption calculating means for calculating the toner consumption for each color component based on the cumulative value stored in the storage unit is provided.

In the present invention as described above, the toner consumption for each color component is calculated based on the cumulative value stored in each storage unit of each first, second and third totaling means, so that the toner consumption for each color component can be controlled. For example, a charge can be imposed based on the toner consumption calculated for each color component, and a maintenance such as toner replacement can be performed for each color component.

An image forming apparatus in accordance with the present invention is characterized in that the first totaling means or the second totaling means includes a buffer memory for adjusting the output timing of pixel values to the adding means such that the addition timing of the adding means of the first totaling means and the addition timing of the adding means of the second totaling means are coincident with each other when a monochromatic image is formed.

In the image forming apparatus in accordance with the present invention as described above, the first totaling means or the second totaling means includes the buffer memory for adjusting the output timing to the adding means of pixel values such that the addition timing of the adding means of the first totaling means and the addition timing of the adding means of the second totaling means are coincident with each other when a monochromatic image is formed on a photosensitive member. Therefore, even if there exists a dislocation in main scanning direction (in direction along the line) between the odd number line and the even number line of a monochromatic image, any addition timing gap can be adjusted so as to eliminate it.

An image forming apparatus in accordance with the present invention is characterized in that the storage unit of the third totaling means is used as the buffer memory when a monochromatic image is formed on the photosensitive member.

In the image forming apparatus in accordance with the present invention as described above, the storage unit of the third totaling means has a function as a buffer memory described above, so that the circuit scale, power consumption and manufacturing cost can be reduced without requiring an appended buffer memory.

An image forming apparatus in accordance with the present invention is characterized by further comprising: saving means for saving the cumulative value stored in the storage unit of the second totaling means when an image formed on the photosensitive member is switched from a monochromatic image to a color image, or conversely switched from a color image to a monochromatic image; and resetting means for resetting the cumulative value stored in the storage unit of the second totaling means to zero after the saving means has completed the saving of the cumulative value stored in the storage unit of the second totaling means.

In the image forming apparatus in accordance with the present invention as described above, when an image formed on a photosensitive member is switched from a monochromatic image to a color image, or conversely switched from a color image to a monochromatic image, the saving means saves the cumulative value stored in the storage unit of the second totaling means, and after the saving is completed, the resetting means resets the cumulative value stored in the storage unit of the second totaling means to zero. Hence, any confusion of the cumulative value for monochromatic component totaled by the second totaling means with the cumulative value for one of the color components can be prevented.

An image forming apparatus in accordance with the present invention is characterized in that when a monochromatic image is formed on the photosensitive member, the adding means of the first totaling means adds the cumulative value totaled by the second totaling means to the cumulative value totaled by the first totaling means, and stores the added result in the storage unit of the first totaling means.

In the image forming apparatus in accordance with the present invention as described above, when a monochromatic image is formed on a photosensitive member, the cumulative value totaled by the second totaling means and the cumulative values totaled by the first totaling means are added by the adding means of the first totaling means, and then stored in the storage unit of the first totaling means. Thus, the storage unit of the second totaling means is not used, thereby allowing the power consumption to be reduced.

The above and further objects and features of the invention will more fully be apparent from the following detailed description with accompanying drawings.

DETAILED DESCRIPTION OF THE PRESENT INVENTION

Hereinafter, the present invention will be more specifically explained based on drawings showing embodiments.

Figure 1:
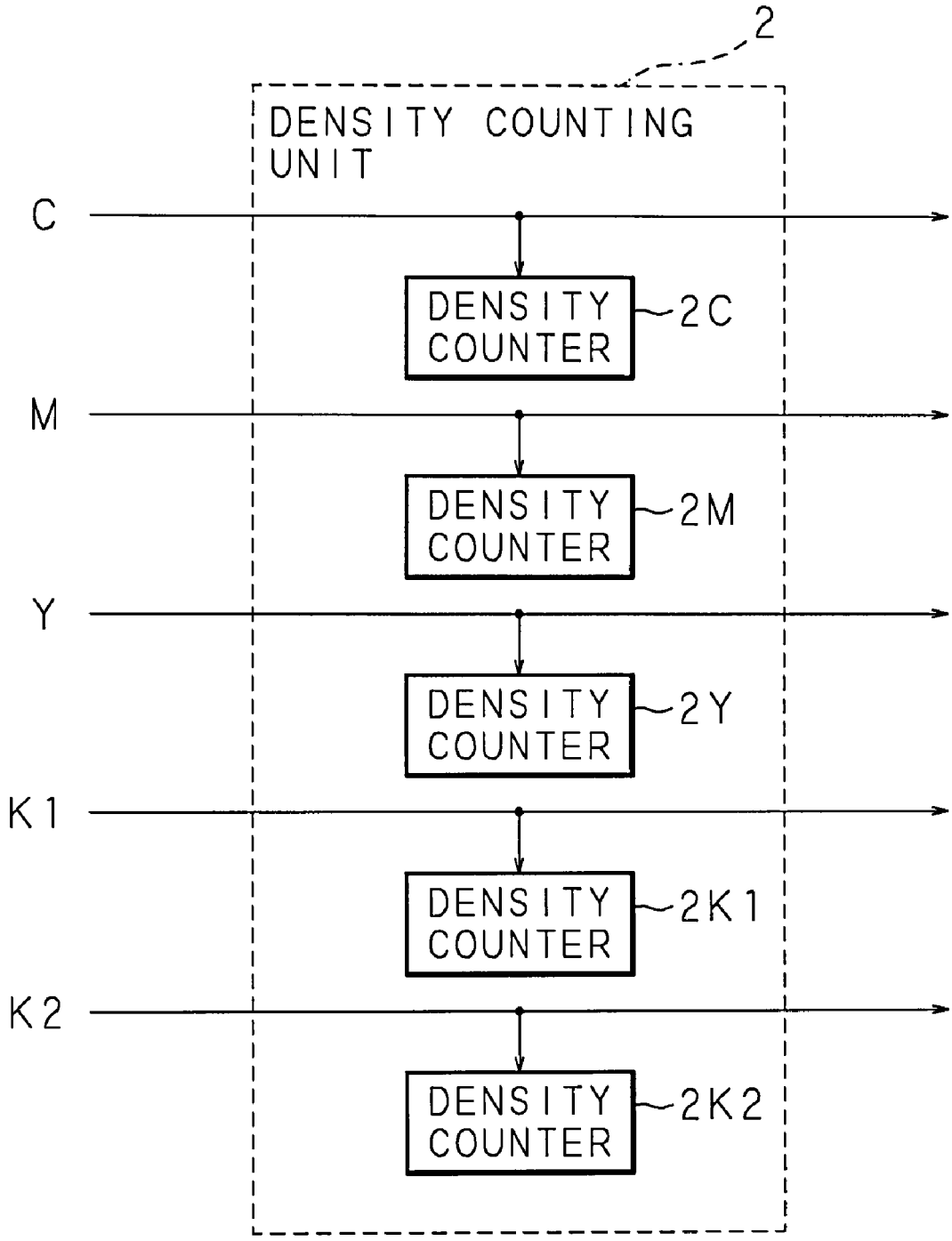
FIG. 1 PRIOR ART
FIG. 1 is a block diagram showing a configuration example of a conventional density counting unit for totaling pixel values (density values) of an image formed on a photosensitive member.
Figure 2:
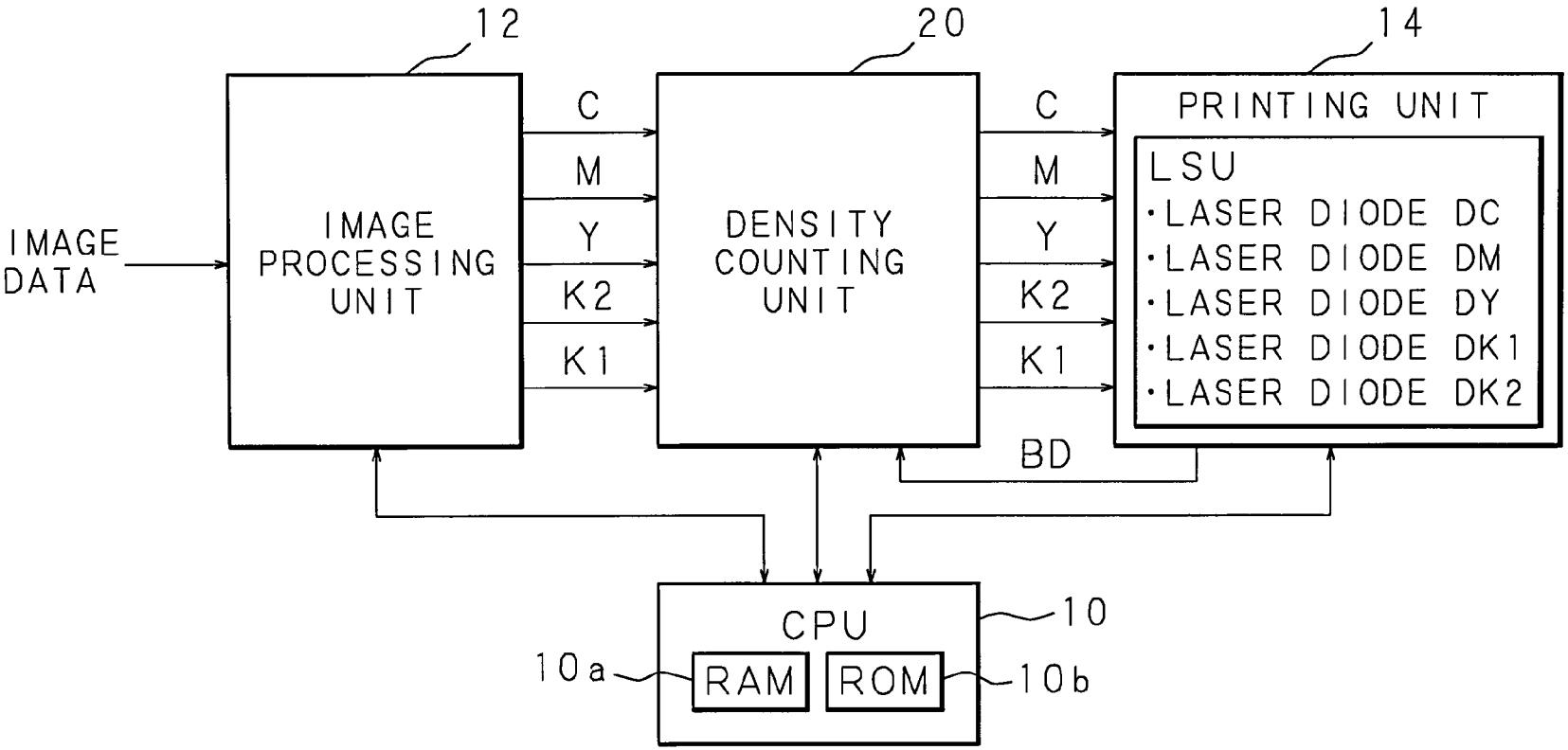
FIG. 2 is a block diagram showing a configuration example of an essential portion of an image forming apparatus in accordance with the present invention.

FIG. 2 is a block diagram showing a configuration example of an essential portion of an image forming apparatus in accordance with the present invention. The image forming apparatus in accordance with the present invention comprises: an image processing unit 12 for performing an conversion from, for example, image data represented by R (Red), G (Green), B (Blue) components into image data represented by C (Cyan), M (Magenta), Y (Yellow), K1 (Black); a printing unit 14 having an LSU (Laser Scanning Unit), a photosensitive dram and the like; a density counting unit 20 for totaling pixel values (density values) of pixels of image data given from the image processing unit 12 to the printing unit 14; a CPU 10 for performing a control of the above-mentioned components within the apparatus; and the like.

Inputted into the image processing unit 12 are image data read by an image reading apparatus, for example, such as an image scanner, or image data received from an external computer through, for example, an NIC (Network Interface Card) and the like. The image processing unit 12, when image data of a color image is inputted, converts the color components of R, G, B into the color components of C, M, Y, K1 to give them to the printing unit 14. Further, the image processing unit 12, when image data of image data of a black and white image (monochromatic image) is inputted, outputs color components of K1 corresponding to the odd number lines and K2 corresponding to the even number lines of the black and white image to the printing unit 14.

The LSU of the printing unit 14 comprises laser diodes DC, DM, DY, DK1, DK2 corresponding to C, M, Y, K1, K2, respectively. When a color image is formed, electrostatic latent images of color component images of C, M, Y, K1 are formed by the laser diodes DC, DM, DY, DK1, DK2, respectively, on a photosensitive member, while when a black and white image is formed, electrostatic latent images of black and white component images of K1 (odd number line) and K2 (even number line) are formed by the laser diode DK1 (first black and white forming means) and the laser diode DK2 (second black and white forming means), respectively, on a photosensitive member. The electrostatic latent images formed on the photosensitive member are formed as images (visible images) by being developed using a toner by a developing unit not shown, and transferred to a sheet. In addition, the printing unit 14 outputs to the density counting unit 20 a signal BD indicating the effect that the processing for one line of the image is completed.

The CPU 10 comprises a ROM (Read Only Memory) 10*b* in which a control program has been stored beforehand and a RAM (Random Access Memory) 10*a* such as a flash memory, and controls each element such as the image processing unit 12, the density counting unit 20 the printing unit 14, and the like according to the control program.

Figure 3:
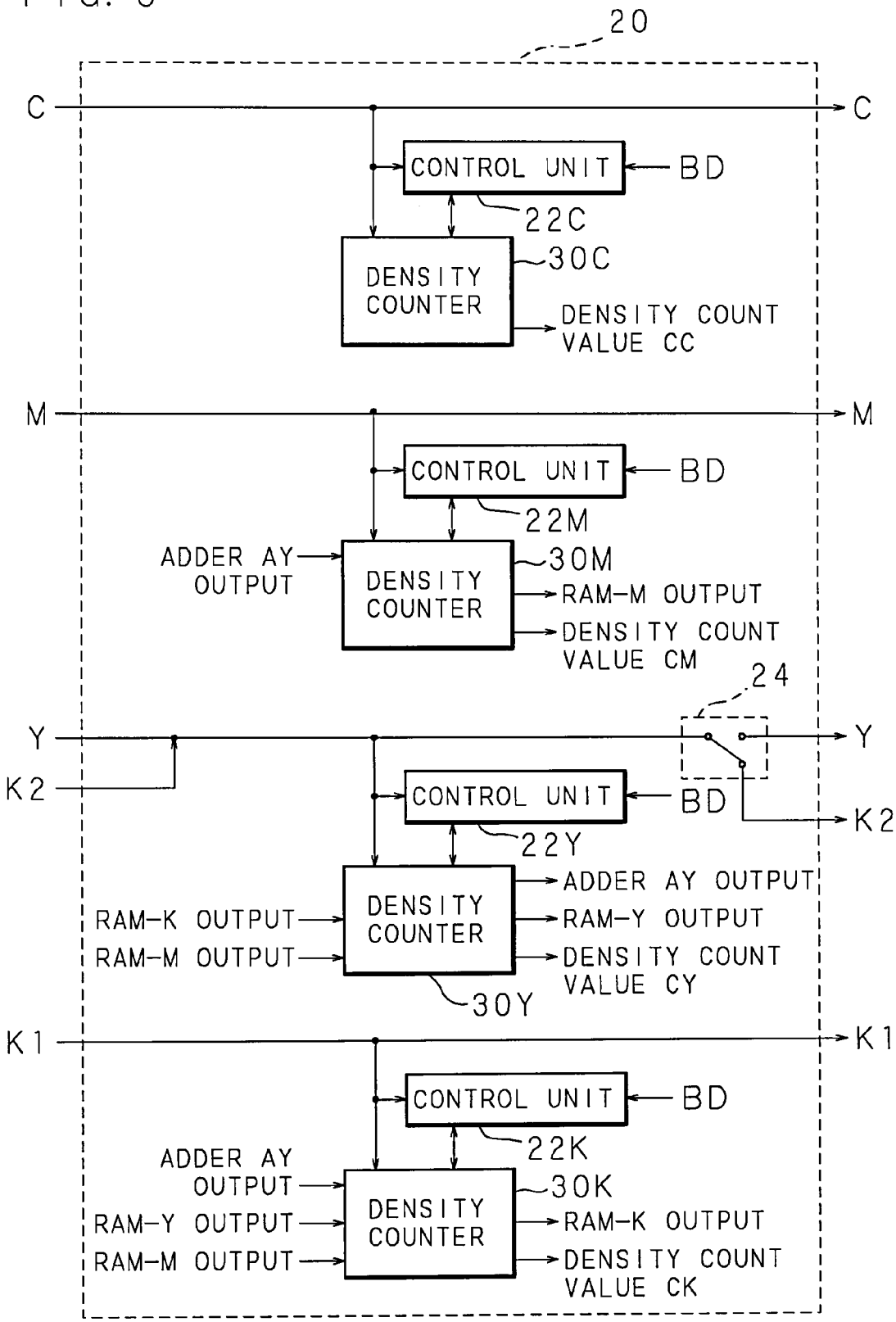
FIG. 3 is a block diagram showing a configuration example of an essential portion of a density counting unit of an image forming apparatus in accordance with the present invention.

FIG. 3 is a block diagram showing a configuration example of an essential portion of the density counting unit 20 of an image forming apparatus in accordance with the present invention. In addition, the density counting unit 20 includes a plurality of units corresponding to each color component.

A unit relating to a color component C includes a density counter 30C (third totaling means) for totaling pixel values of the color component C inputted from the image processing unit 12, and a control unit 22C for controlling the density counter 30C according to the signal BD inputted from the printing unit 14.

A unit relating to a color component M includes a density counter 30M (third totaling means) for totaling pixel values of the color component M inputted from the image processing unit 12, and a control unit 22M for controlling the density counter 30M according to the signal BD inputted from the printing unit 14.

A unit relating to a color component Y includes a density counter 30Y (second totaling means) for totaling pixel values of the color component Y (a predetermined color component) or K2 (a monochromatic component) both inputted from the image processing unit 12, and a control unit 22Y for controlling the density counter 30Y according to the signal BD inputted from the printing unit 14. Further, the unit relating to a color component Y further includes a selection unit 24 controlled by the CPU 10 so as to select the Y input of the printing unit 14 when the color component Y is inputted to the density counting unit 20, while select the K2 input of the printing unit 14 when the color component K2 is inputted to the density counting unit 20.

A unit relating to a color component K1 includes a density counter 30K (first totaling means) for totaling pixel values of the color component K1 (a monochromatic component) inputted from the image processing unit 12, and a control unit 22K for controlling the density counter 30K according to the signal BD inputted from the printing unit 14.

The configuration and operation of density counters 30C, 30M, 30Y, 30K are basically identical to each other. Also, the configuration and operation of control units 22C, 22M, 22Y, 22K are also basically identical to each other. Therefore, in the description below, when the density counters 30C, 30M, 30Y, 30K are not required to be distinguished, they are described simply as the density counter 30, while when the control units 22C, 22M, 22Y, 22K are not required to be distinguished, they are described simply as the control unit 22.

Figure 4:
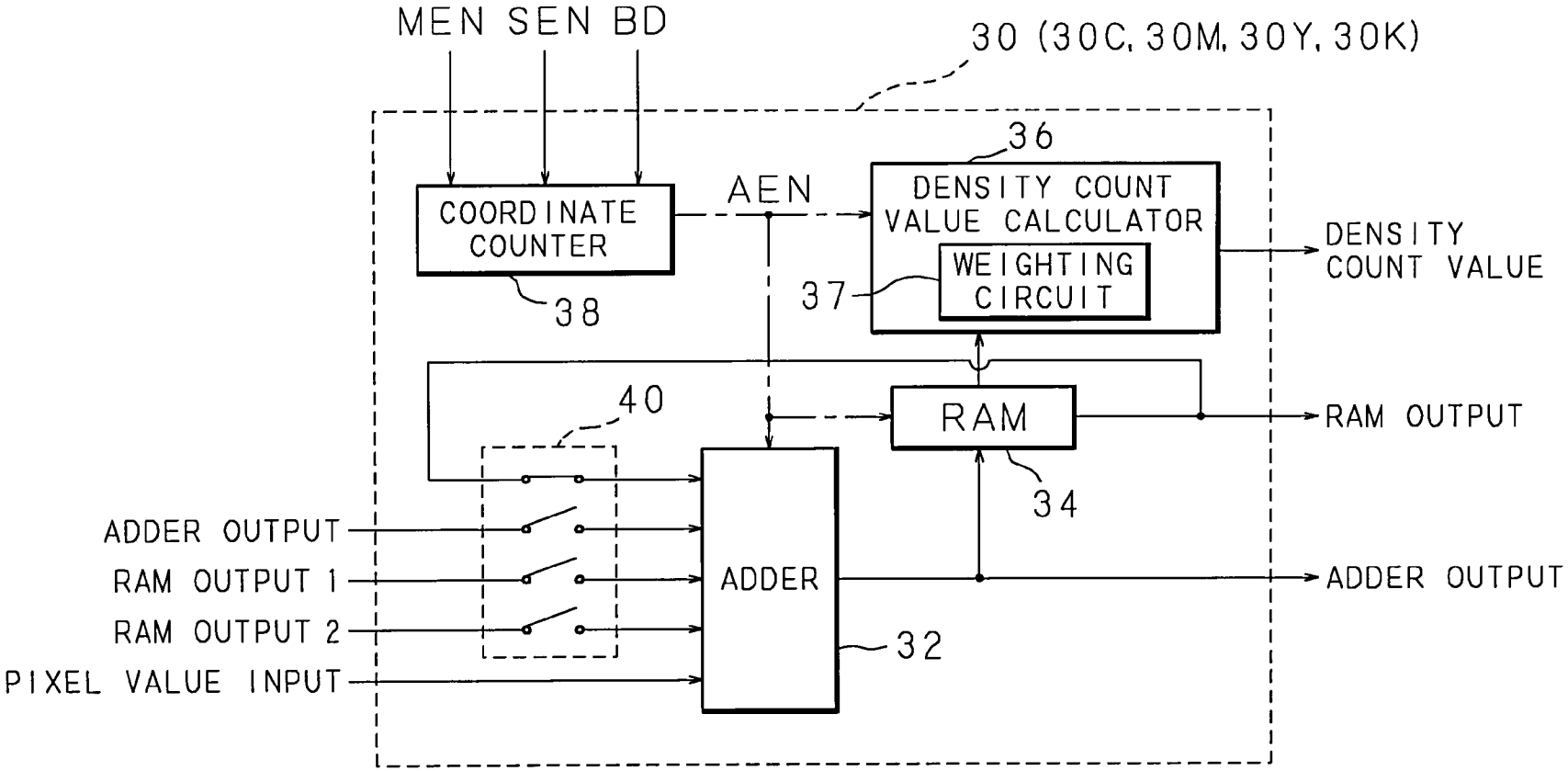
FIG. 4 is a block diagram showing a configuration example of density counters of a density counting unit of an image forming apparatus in accordance with the present invention.

FIG. 4 is a block diagram showing a configuration example of each density counter of a density counting unit of an image forming apparatus in accordance with the present invention.

The density counter 30 (30C, 30M, 30Y, 30K) includes: a coordinate counter 38 for counting the coordinate of pixels to be processed with respect to the entire image; a RAM 34 (a storage unit) for storing cumulative values of pixel values (density values); a density count value calculator 36 having a weighting circuit 37 for weighting the cumulative values stored in the RAM 34 and calculating density count values; a selection unit 40 for selecting whether or not the cumulative value stored in the RAM 34 and an input value from the outside are independently inputted to an adder 32 by the control of the control unit 22 (22C, 22M, 22Y, 22K); and the adder 32 (adding means) for adding the value selected by the selection unit 40 to the pixel value input. In addition, the added result of the adder 32 is outputted outside the density counter 30, and at the same time, stored in the RAM 34.

In a normal state, the selection unit 40 is made to be a state in which the selection unit 40 selects only an output value from the RAM 34 and inputs the value into the adder 32.

Figure 5:
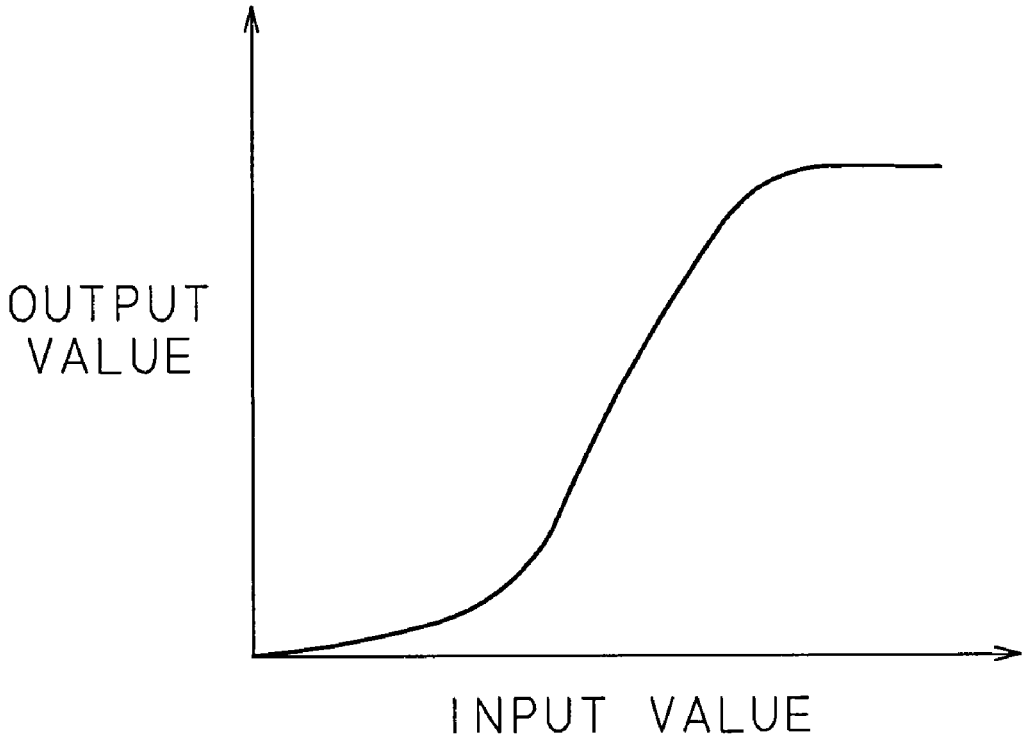
FIG. 5 is a graph showing an example of input/output characteristics of a weighting circuit of a density counting unit of an image forming apparatus in accordance with the present invention.
Figure 6:
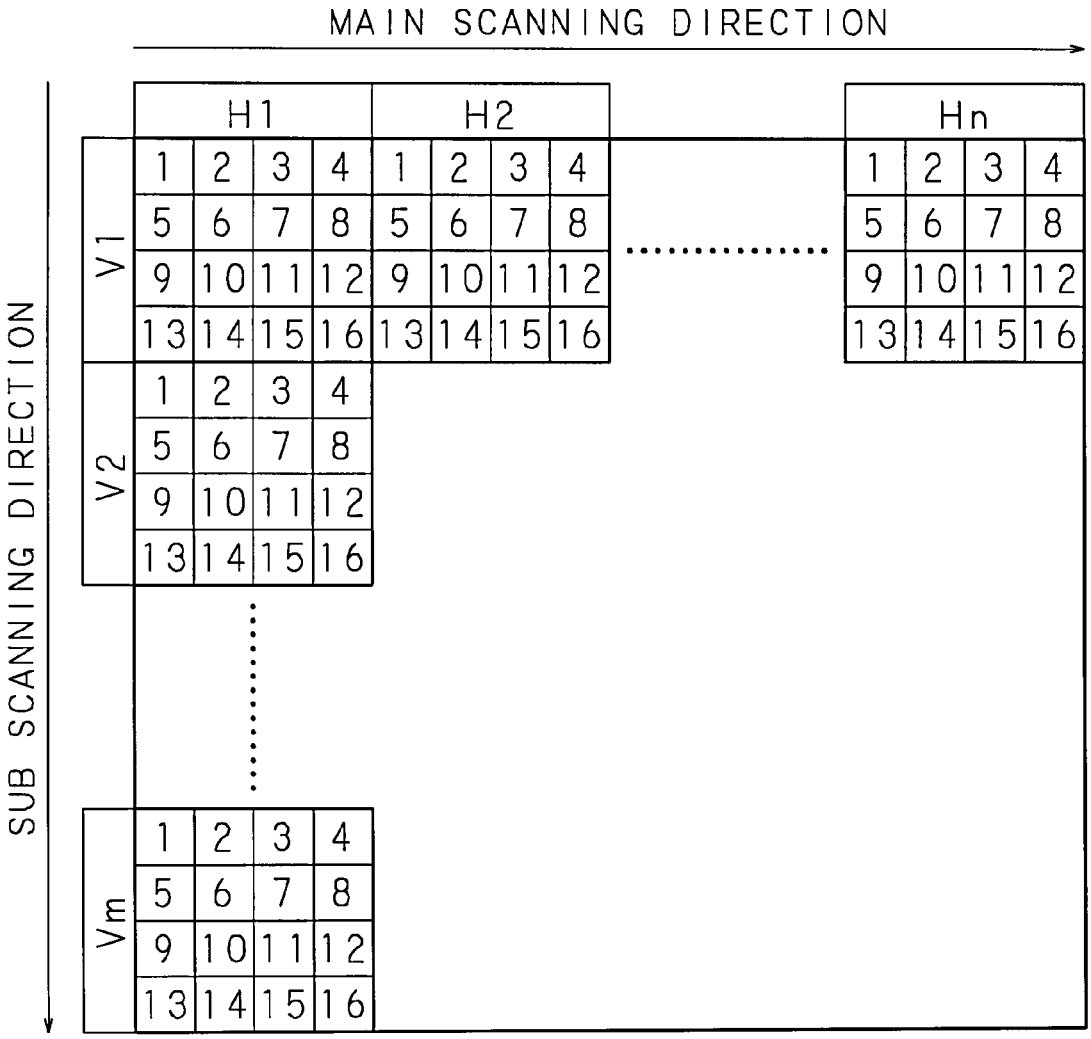
FIG. 6 is a typical view showing conceptually a pixel configuration example of an entire image to be processed by an image forming apparatus in accordance with the present invention.

The weighting circuit 37 is a circuit for correcting the density count value to be approximate to an actual toner consumption value. More specifically, the weighting circuit 37, as shown in FIG. 6 later described, weights a density count value obtained by totaling "main scanning direction×sub-scanning direction" in units of a block of four pixels×four pixels. The graph of FIG. 5 shows an example of the input/output characteristics (the relation of an output value with an input value) of the weighting circuit 37. Further, as apparent from FIG. 5, the input/output characteristics of the weighting circuit 37 are large in the increasing rate of the output value when the input value is in an intermediate region, and small in the increasing rate of the output value when the input value is relatively small and large rather than in an intermediate region.

The control unit 22 (22C, 22M, 22Y, 22K) shown in FIG. 3 produces a main enable signal (MEN) indicating a pixel region with respect to the main scanning direction (horizontal direction) of the entire image and a sub-enable signal (SEN) indicating a pixel region with respect to the sub-scanning direction (vertical direction) of the entire image according to the signal BD outputted from the printing unit 14, and outputs them to the coordinate counter 38. The coordinate counter 38 outputs a pixel region signal (an addition enable signal: AEN) with respect to the entire image to the adder 32, the RAM 34, and the density count value calculator 36. Further, the control unit 22 (22C, 22M, 22Y, 22K) is controlled by the CPU 10, and controls the elements 32, 34, 36, 38, 40 of the density counter 30 (30C, 30M, 30Y, 30K).

Hereinafter, in the density counters 22C, 22M, 22Y, 22K, the adders 32 are described as the adders AC, AM, AY, AK, respectively; the RAMs 34, as the RAM-C, RAM-M, RAM-Y, RAM-K, respectively; the selection units 40, as the selection units 40C, 40M, 40Y, 40K, respectively; and the density count value adders 36, as the density count value adders 36C, 36M, 36Y, 36K, respectively.

Further, the density count values outputted from the density count value adders 36C, 36M, 36Y, 36K are described as the density count values CC, CM, CY, CK, respectively; the output values of the RAM-C, RAM-M, RAM-Y, RAM-K, as the RAM-C output, RAM-M output, RAM-Y output, RAM-K output, respectively; and the output values of the adders AC, AM, AY, AK, as the adder AC output, adder AM output, adder AY output, adder AK output, respectively.

As shown in FIG. 3, the density counter 30C outputs the density count value CC. The density counter 30M outputs the RAM-M output and the density count value CM. Further, inputted to the density counter 30M is the adder AY output. The density counter 30Y outputs the adder AY output, the RAM-Y output and the density count value CY. Further, inputted to the density counter 30Y are the RAM-K output and the RAM-M output. The density counter 30K outputs the RAM-K output and the density count value CK. Further, inputted to the density counter 30K are the adder AY output, the RAM-Y output and the RAM-M output.

The density count values CC, CM, CY, CK are inputted to the CPU 10. In addition, the configuration of the selection units 40C, 40M, 40Y, 40K can be changed according to the number of inputs, respectively. For example, the selection unit 40C is not required to be inputted with the adder output and the RAM outputs 1 and 2 shown in FIG. 4; the selection unit 40M is not required to be inputted with the RAM outputs 1 and 2 shown in FIG. 4; and the selection unit 40Y is not required to be inputted with the adder output shown in FIG. 4.

FIG. 6 is a typical view showing conceptually a pixel configuration example of an entire image to be processed by an image forming apparatus in accordance with the present invention. In the example shown in FIG. 6, with respect to the main scanning direction, the configuration is divided into blocks by four pixels, H1, H2, . . . , Hn (provided that n is integer), while with respect to the sub-scanning direction, the configuration is divided into blocks by four pixels, V1, V2, . . . , Vm (provided that m is integer).

Figure 7A:
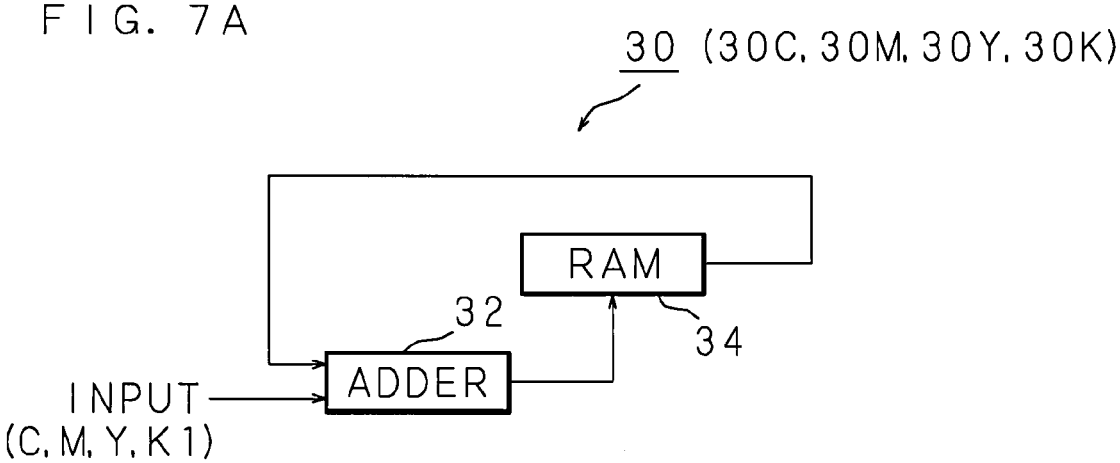
FIG. 7A, FIG. 7B and FIG. 7C are explanatory views showing conceptually the operation of a density counter when an image forming apparatus in accordance with the present invention totals pixel values of color components of a color image.
Figure 7B:
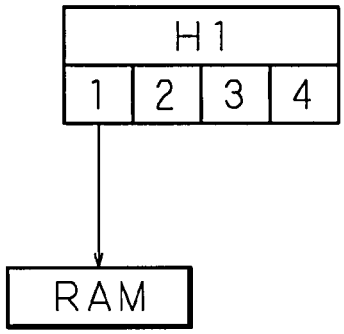
Figure 7C:
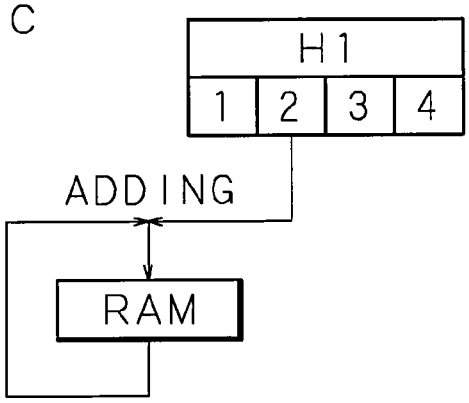

FIG. 7A, FIG. 7B and FIG. 7C are explanatory views showing conceptually the operation of the density counters 30C, 30M, 30Y, 30K when the image forming apparatus in accordance with the present invention totals pixel values of color components of a color image.

When the image forming apparatus in accordance with the present invention performs the printing of a color image, the selection unit 24 of the density counting unit 20 is switched to the color component Y side by the CPU 10. This causes the color components C, M, Y, K1 to be inputted to the density counters 30C, 30M, 30Y, 30K, respectively. However, when the printing of a color image is performed, K1 includes both the odd number line and the even number line. As shown in FIG. 7A, the adder 32 (AC, AM, AY, AK) of the density counter 30 (30C, 30M, 30Y, 30K) adds an input (color component C, M, Y, K1) to a value stored in the RAM 34 (RAM-C, RAM-M, RAM-Y, RAM-K) and overwrites the added result in the RAM 34 to be stored. For example, at the starting of the density count, as shown in FIG. 7B, an input pixel value is stored in the RAM 34, and thereafter, as shown in FIG. 7C, the value stored in the RAM 34 is added to an input pixel value, and the added result is stored in the RAM 34. Thus, the cumulative value of input pixel values is stored in the RAM 34.

Figure 8:
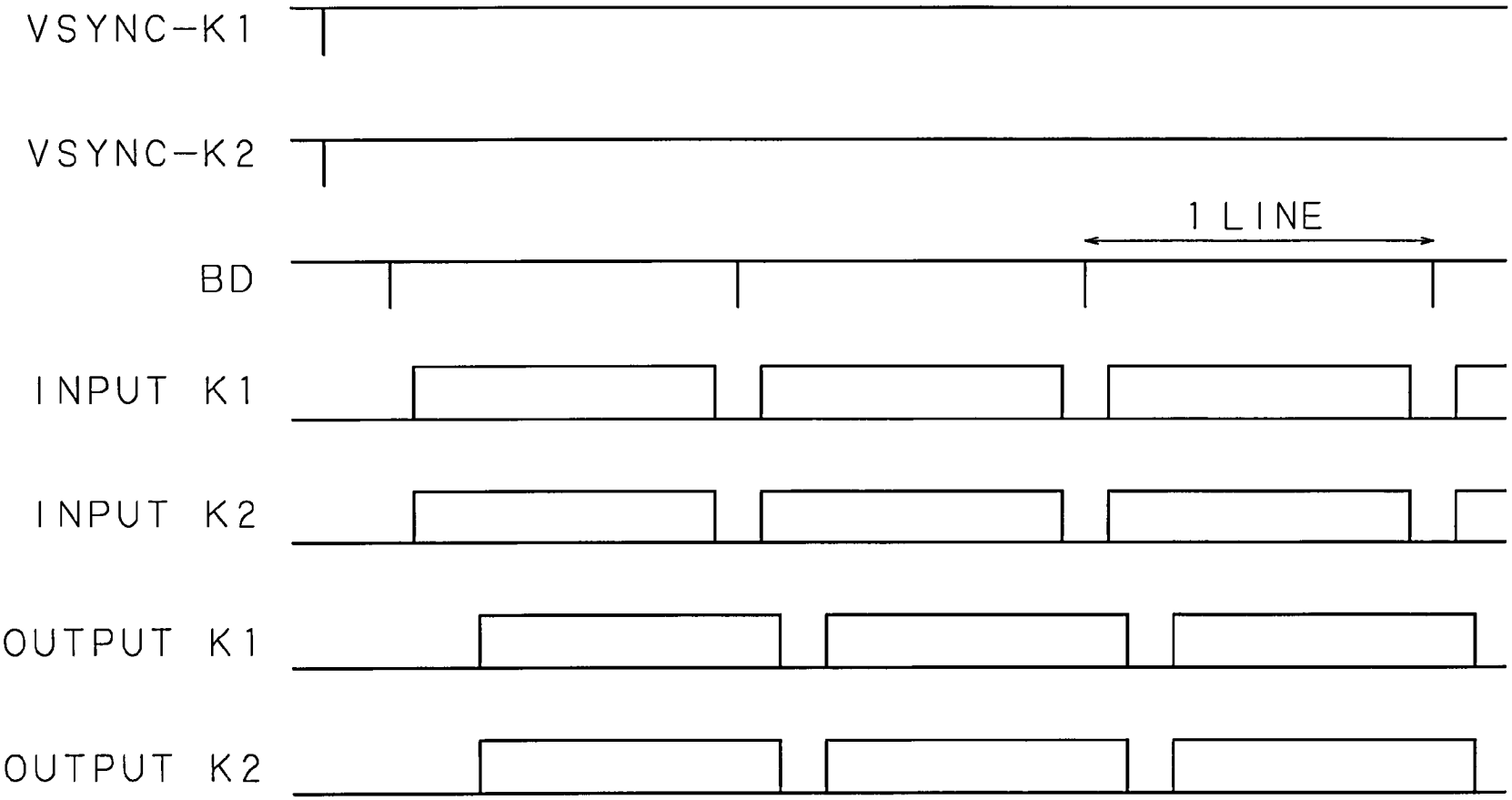
FIG. 8 is a timing chart showing an example of the input/output timing of color components of odd number lines and of color components of even number lines of a black and white image.
Figure 9:
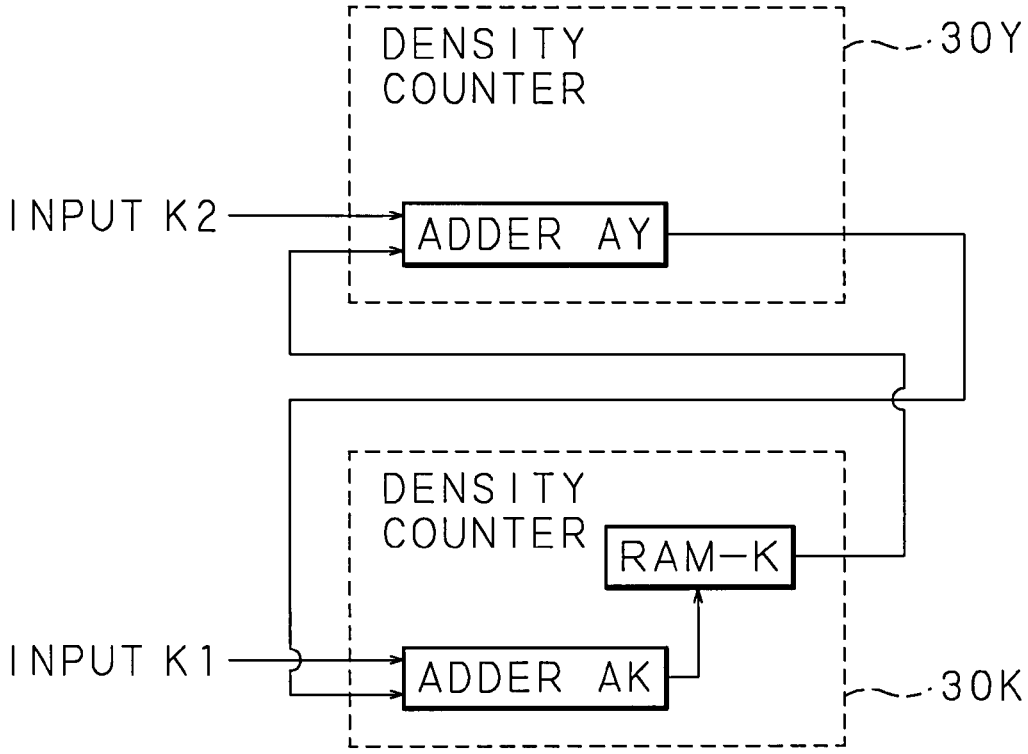
FIG. 9 is a typical view showing conceptually the operation of a density counter when an image forming apparatus in accordance with the present invention totals pixel values of color components of a black and white image as shown in the timing chart of FIG. 8.
Figure 10A:
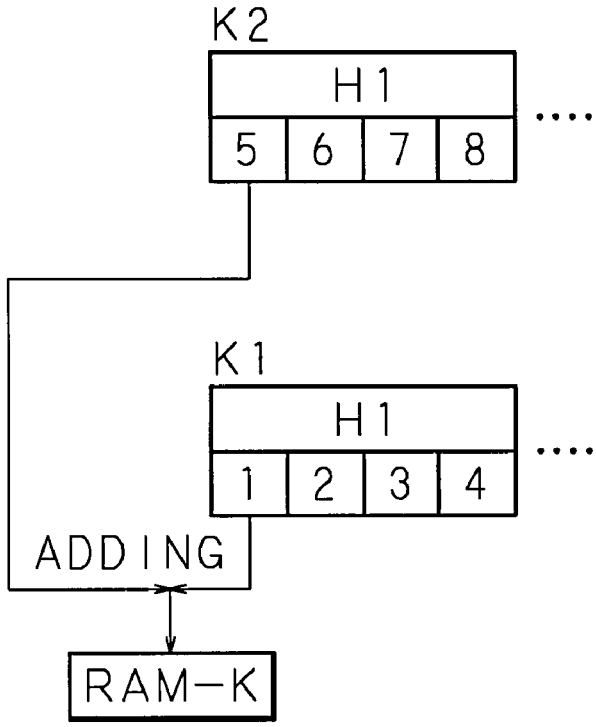
FIG. 10A and FIG. 10B are typical views showing conceptually the operation of a density counter when an image forming apparatus in accordance with the present invention totals pixel values of color components of a black and white image as shown in the timing chart of FIG. 8.
Figure 10B:
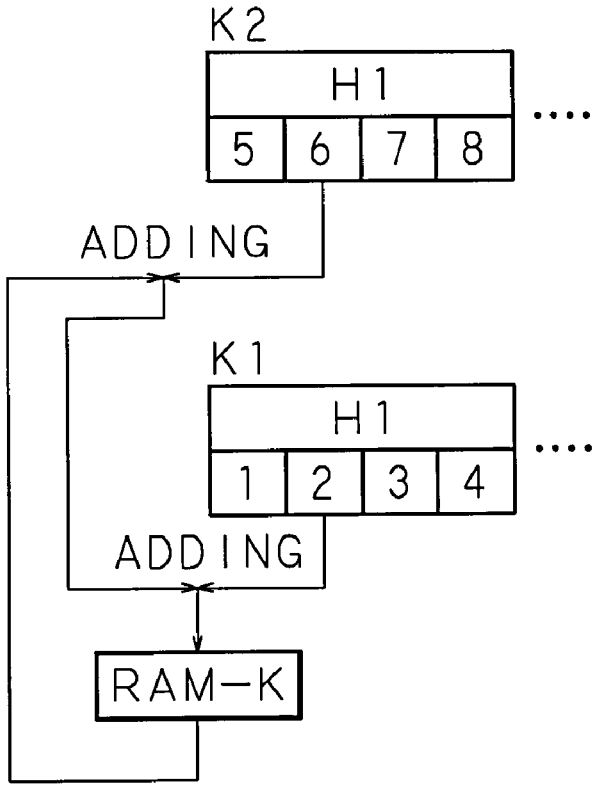

FIG. 8 is a timing chart showing an example of the input/output timing of the color component K1 of odd number lines and of the color component K2 of even number lines of a black and white image. FIG. 9, FIG. 10A and FIG. 10B are typical views showing conceptually the operation of the density counters 30Y and 30K when an image forming apparatus in accordance with the present invention totals pixel values of the color components K1 and K2 of a black and white image as shown in the timing chart of FIG. 8. In addition, in the example of a black and white image shown in FIG. 8, the input timing of the input K1 and the input K2 is substantially coincident with each other.

When the image forming apparatus in accordance with the present invention performs the printing of a black and white image, the selection unit 24 of the density counting unit 20 is switched to the color component K2 side by the CPU 10. This causes the color components K2 and K1 to be inputted to the density counters 30Y and 30K, respectively. Further, by the control of the CPU 10, the selection unit 40Y of the density counter 30Y selects the RAM-K output, and the selection unit 40K of the density counter 30K selects the adder AY output.

As shown in FIG. 9, the adder AY of the density counter 30Y adds the input K2 to the cumulative value stored in the RAM-K of the density counter 30K, and outputs the added result (the adder AY output) to density counter 30K. The density counter 30K adds the input K1 to the adder AY output of the counter 30Y, and overwrites the added result in the RAM-K to be stored. For example, at the starting of the density count, as shown in FIG. 10A, the added result of the K1 and the K2 is stored in the RAM-K, and thereafter, as shown in FIG. 10B, the value stored in the RAM-K is added to the input K2, and the added result is further added to the input K1, and the added result is stored in the RAM-K. Therefore, stored in the RAM-K is the cumulative value obtained by adding the cumulative value of the K1 to the cumulative value of the K2.

The CPU 10 obtains the density count values CC, CM, CY, CK by controlling the density counters 30C, 30M, 30Y, 30K of the density counting unit 20. Then, the CPU 10 calculates the toner consumption for each color component based on the density count values CC, CM, CY, CK thus obtained, and stores the calculated result in the RAM 10*a*. Therefore, the CPU 10 functions as toner consumption calculating means.

Further, the CPU 10, when the image to be formed is changed between a black and white image and a color image, obtains the cumulative value (density count value CY) stored in the density counter 30Y, and saves once in appropriate storing means such as the RAM 10*a*, and thereafter, resets the cumulative value stored in the density counter 30Y to zero. In addition, the CPU 10 stores in the RAM 10*a* a printing mode flag (for example, "1" for color printing, "0" for black and white printing) indicating whether color printing or black and white printing has been performed. Thus, the CPU 10 functions as saving means and resetting means for the cumulative value.

Figure 11:
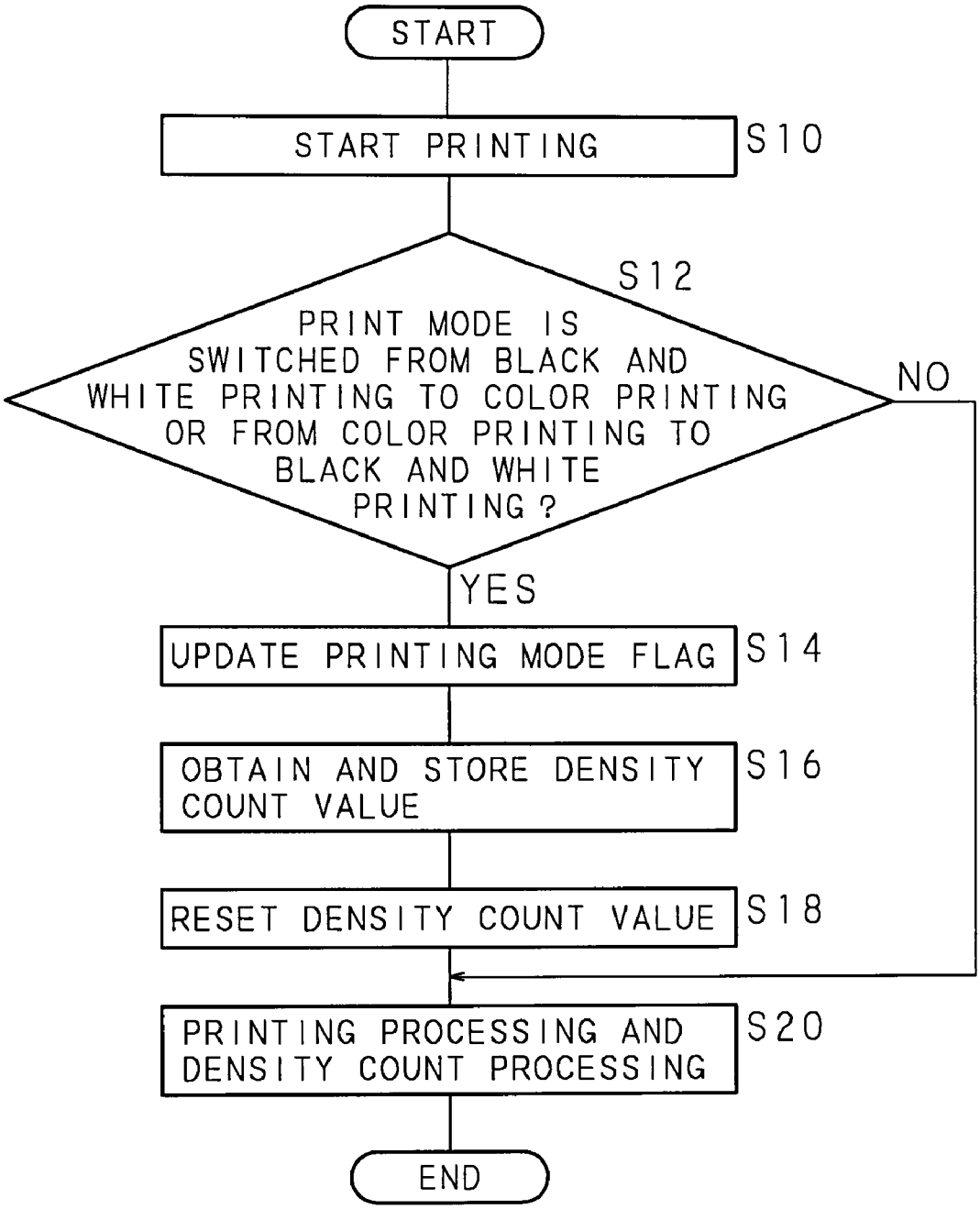
FIG. 11 is a flowchart showing an example of a procedure for saving and resetting the density count values when the color printing and monochromatic printing are switched to each other by an image forming apparatus in accordance with the present invention.

FIG. 11 is a flowchart showing an example of a procedure for saving and resetting the density count values when the color printing and monochromatic printing are switched with each other by the image forming apparatus in accordance with the present invention.

When printing is started (S10), the CPU 10 judges whether the printing mode is switched or not, that is, whether the switching from a black and white printing to a color printing or from a color printing to a black and white printing has been performed or not (step S12). When it has been judged that the printing mode has been switched (S12: YES), the CPU 10 updates the printing mode flag (S14). The update of the printing mode flag is either from "1" to "0" or from "0" to "1". Thereafter, the CPU 10 obtains the density count value CY by controlling the density counter 30Y of the density counting unit 20, and stores (saves) the density count value thus obtained in, for example, the RAM 10*a* (S16). Then, the CPU 10 resets the density count value CY of the density counter 30Y to zero (S18). Thereafter, by controlling of the CPU 10, the printing processing by the printing unit 14 and the density count processing by the density counting unit 20 are performed (S20). In addition, when it has been judged that the switching of the printing mode has not been performed at S12 (S12: NO), the CPU 10 performs the printing processing by the printing unit 14 and the density count processing by the density counting unit 20 without performing the above-mentioned processes S14 through S18.

Figure 12A:
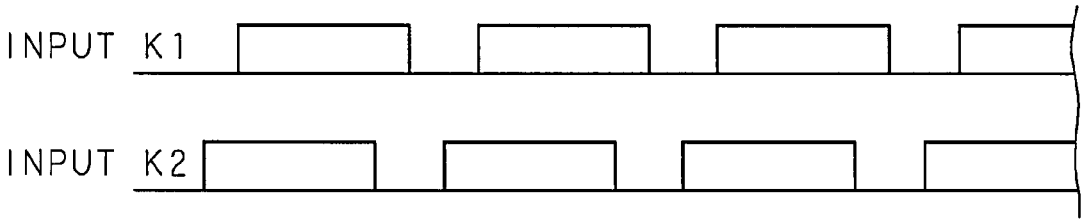
FIG. 12A is a timing chart showing an example of non-coincidence of the input timing of an input K1 with that of an input K2.
Figure 12B:
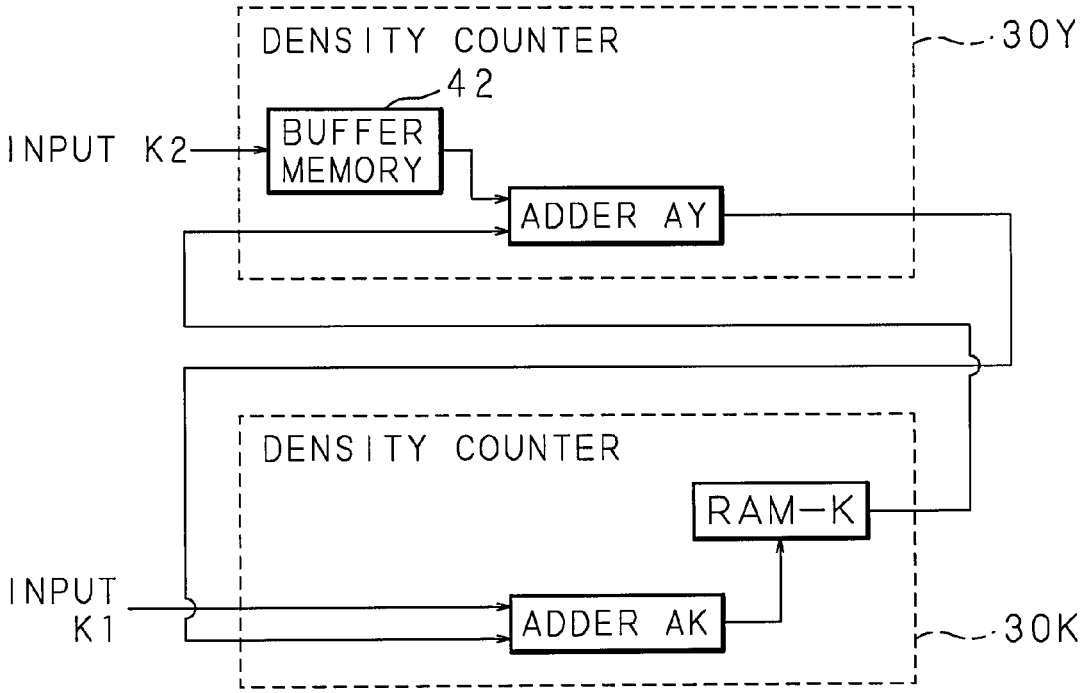
FIG. 12B is a block diagram showing another configuration example of an essential portion of a density counter of the image forming apparatus in accordance with the present invention.
Figure 13A:
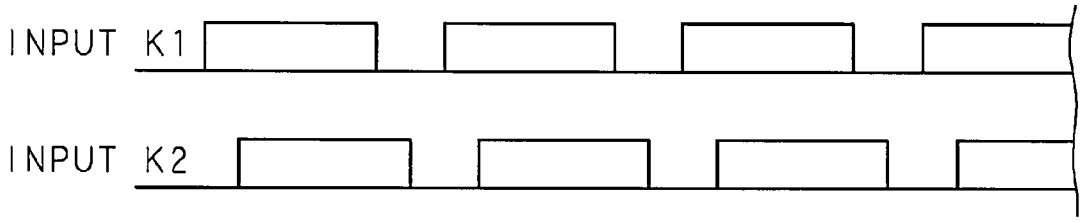
FIG. 13A is a timing chart showing an example of non-coincidence of the input timing of an input K1 with that of an input K2.
Figure 13B:
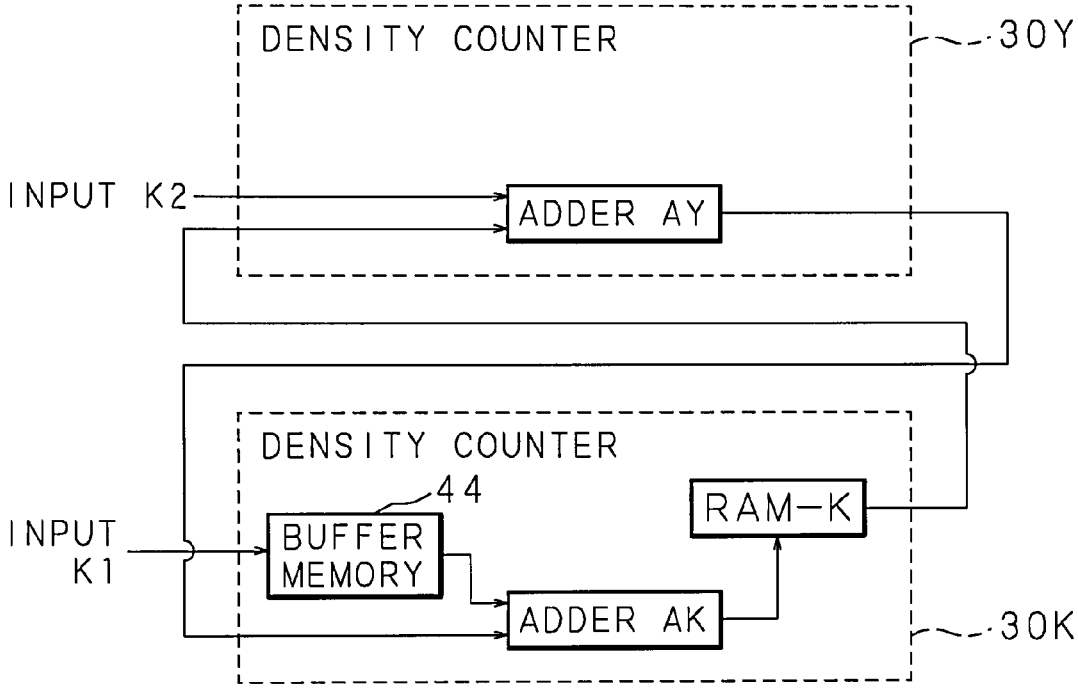
FIG. 13B is a block diagram showing another configuration example of an essential portion of a density counter of the image forming apparatus in accordance with the present invention.

Although, in the above-mentioned embodiment, the input timing of the input K1 and the input K2 is substantially coincident with each other, there can be a case where the input timing of both inputs is not coincident with each other. FIG. 12A and FIG. 13A are timing charts showing an example of non-coincidence of the input timing of an input K1 with that of an input K2, and FIG. 12B and FIG. 13B are block diagrams showing another configuration example of an essential portion of a density counter of the image forming apparatus in accordance with the present invention.

Note that, in an example shown in the timing chart of FIG. 12A, the input timing of the input K1 is behind the timing of the input K2. On the other hand, as shown in FIG. 12B, appended to the density counter 30Y is a buffer memory 42 for buffering the input K2 to the adder AY. With the buffer memory 42, the addition timing of the input K2 is adjusted. More specifically, by delaying the input timing of the input K2 with the buffer memory 42, the input timing of the input K2 is adjusted to be coincident with the input timing of the input K1. In addition, the buffer memory 42 may be appended, for example, to a position (between the adder AY and the adder AK) in which the input timing of the adder AY output to the adder AK of the density counter 30K can be delayed.

Further, in an example shown in the timing chart of FIG. 13A, the input timing of the input K2 is behind the timing of the input K1. On the other hand, as shown in FIG. 13B, appended to the density counter 30K is a buffer memory 44 for buffering the input K1 to the adder AK. With the buffer memory 44, the addition timing of the input K1 is adjusted. More specifically, by delaying the input timing of the input K1 with the buffer memory 44, the input timing of the input K1 is adjusted to be coincident with the input timing of the input K2.

In addition, whether the buffer memories 42, 44 are used or not is controlled by the CPU 10 according to the input timing of both the inputs K1 and K2.

Figure 14:
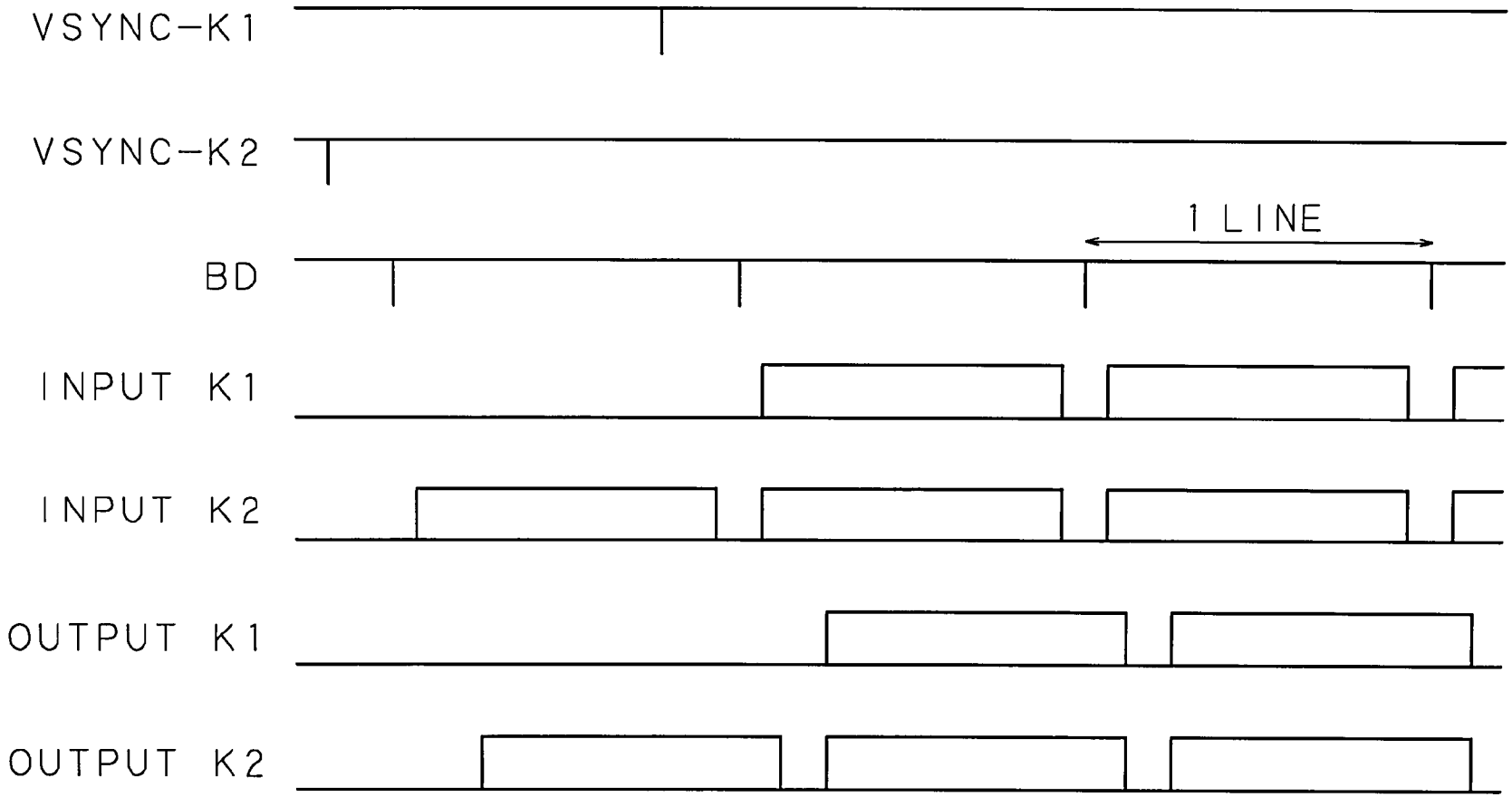
FIG. 14 is a timing chart showing another example of the input/output timing of color components of odd number lines and of color components of even number lines of a black and white image.

Although, in the above-mentioned embodiments, both the K1 and K2 are inputted at the starting of input, there can be a case where only one of the K1 and K2 is inputted at the starting of input. FIG. 14 is a timing chart showing another example of the input/output timing of color components of odd number lines and of color components of even number lines of a black and white image, which differs in the input starting timing of the inputs K1 and K2 from the timing chart shown in FIG. 8.

In the example shown in the timing chart of FIG. 14, only the input K2 is inputted at the starting of input. FIG. 15A and FIG. 15B, and FIG. 16A and FIG. 16B are typical views showing conceptually the operation of the density counters 30Y and 30K in a case where the image forming apparatus in accordance with the present invention totals pixel values of the color components K1 and K2 of a black and white image when only the input K2 is inputted at the starting of input, as shown in the timing chart of FIG. 14.

Figure 15A:
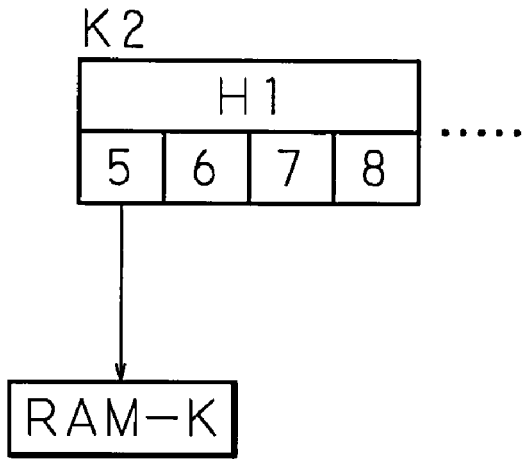
FIG. 15A and FIG. 15B are typical views showing conceptually the operation of a density counter when an image forming apparatus in accordance with the present invention totals pixel values of color components of a black and white image as shown in the timing chart of FIG. 14.
Figure 15B:
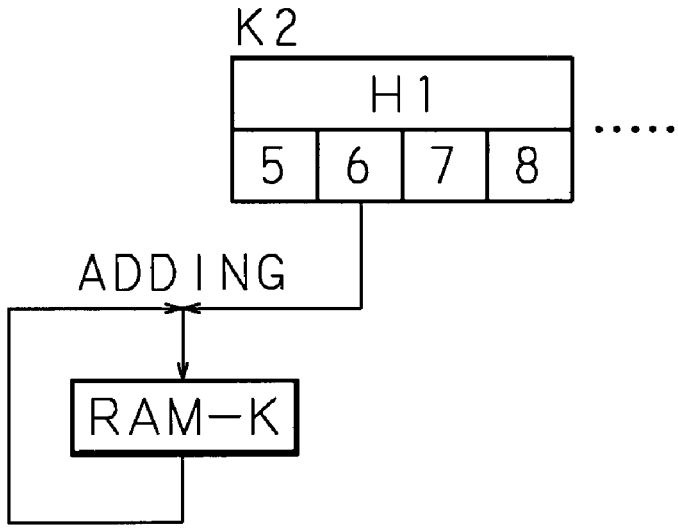
Figure 16A:
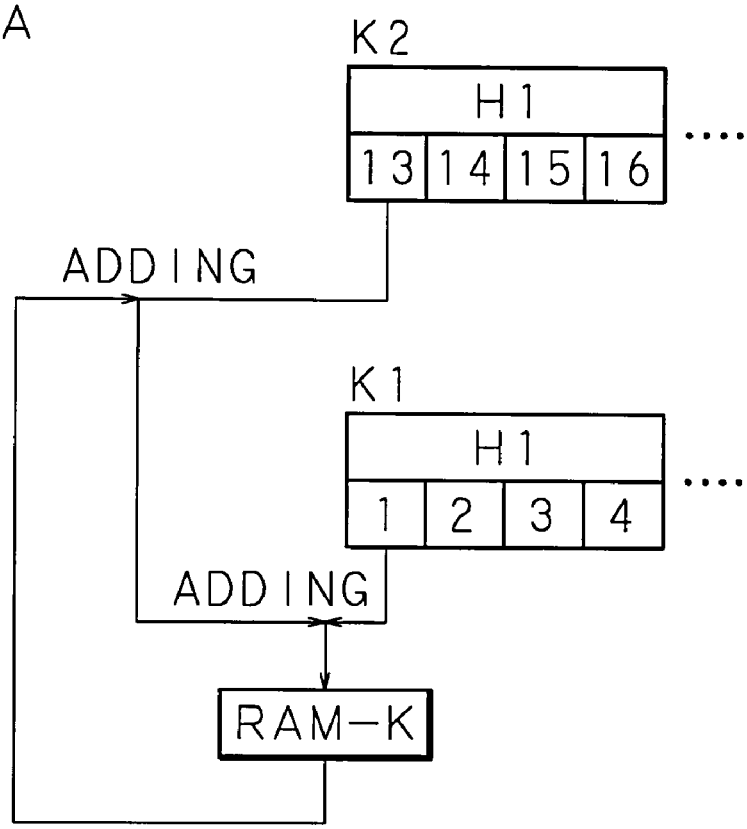
FIG. 16A and FIG. 16B are typical views showing conceptually the operation of a density counter when an image forming apparatus in accordance with the present invention totals pixel values of color components of a black and white image as shown in the timing chart of FIG. 14.
Figure 16B:
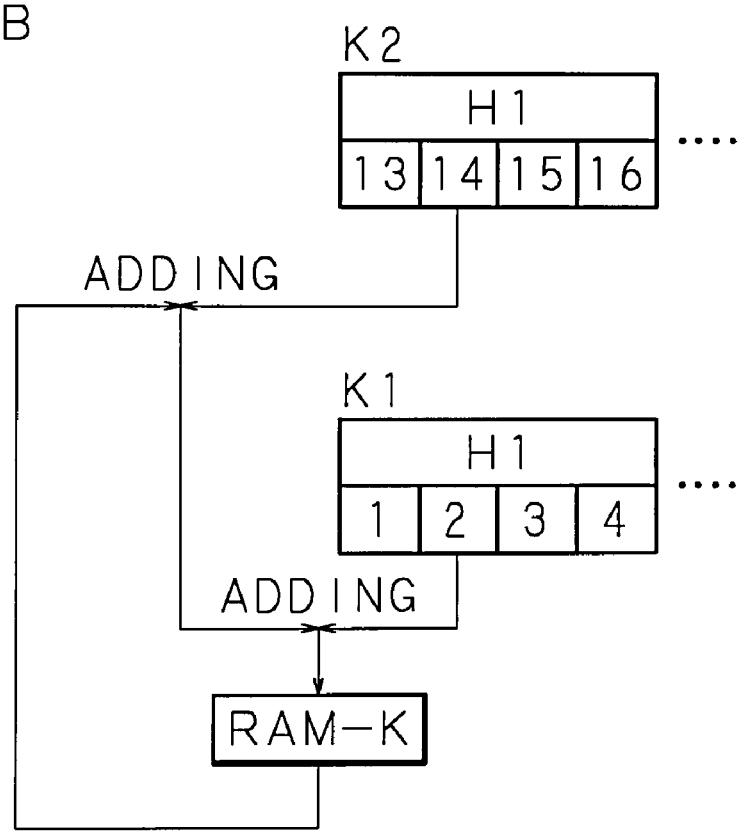

Also in this case similar to the case shown in FIG. 9, the adder AY of the density counter 30Y adds the input K2 to the cumulative value stored in the RAM-K of the density counter 30K, and outputs the added result (the adder AY output) to density counter 30K. The density counter 30K adds the input K1 to the adder AY output of the counter 30Y, and overwrites the added result in the RAM-K to be stored. For example, at the starting of the density count, as shown in FIG. 15A, the added result of the K2 is stored in the RAM-K, and by the time when processing for one line is finished, as shown in FIG. 15B, the cumulative value stored in the RAM-K is added to the input K2, and the added result is stored in the RAM-K. After the next line, as shown in FIG. 16A, FIG. 16B, the value stored in the RAM-K is added to the input K2, and the added result is further added to the input K1, and then the added result is stored in the RAM-K.

Further, the configuration of the density counters can be made such that the RAM-Y of the density counter 30Y and the RAM-M of the density counter 30M are configured as memories having functions as buffer memories, rather than that the buffer memories 42 and 44 are added thereto as shown in FIG. 12 and FIG. 13.

Figure 17:
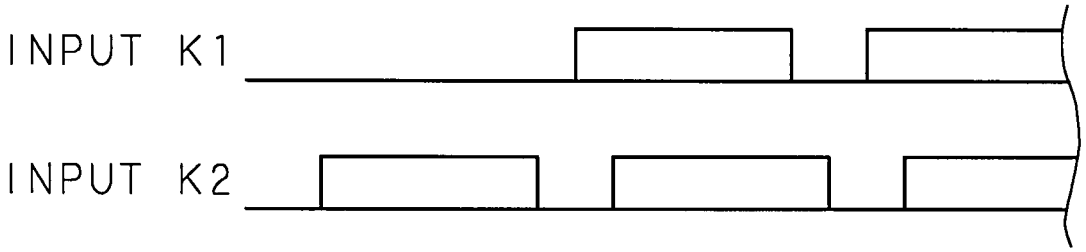
FIG. 17 is a view showing another example of the input/output timing of the color component K1 of odd number lines and of the color component K2 of even number lines of a black and white image.

FIG. 17 is a timing chart showing another example of the input/output timing of the color component K1 of odd number lines and of the color component K2 of even number lines of a black and white image, and FIG. 18 through FIG. 25 are typical views showing conceptually the operation of the density counters 30M, 30Y and 30K when the image forming apparatus in accordance with the present invention totals pixel values of the color components K1 and K2 of a black and white image as shown in the timing chart of FIG. 17. In addition, in the timing chart shown in FIG. 17, at the starting of input, only the input K2 is inputted, and also when both the inputs K1 and K2 are inputted, the input timing of the input K2 is behind the input timing of the input K1.

Figure 18:
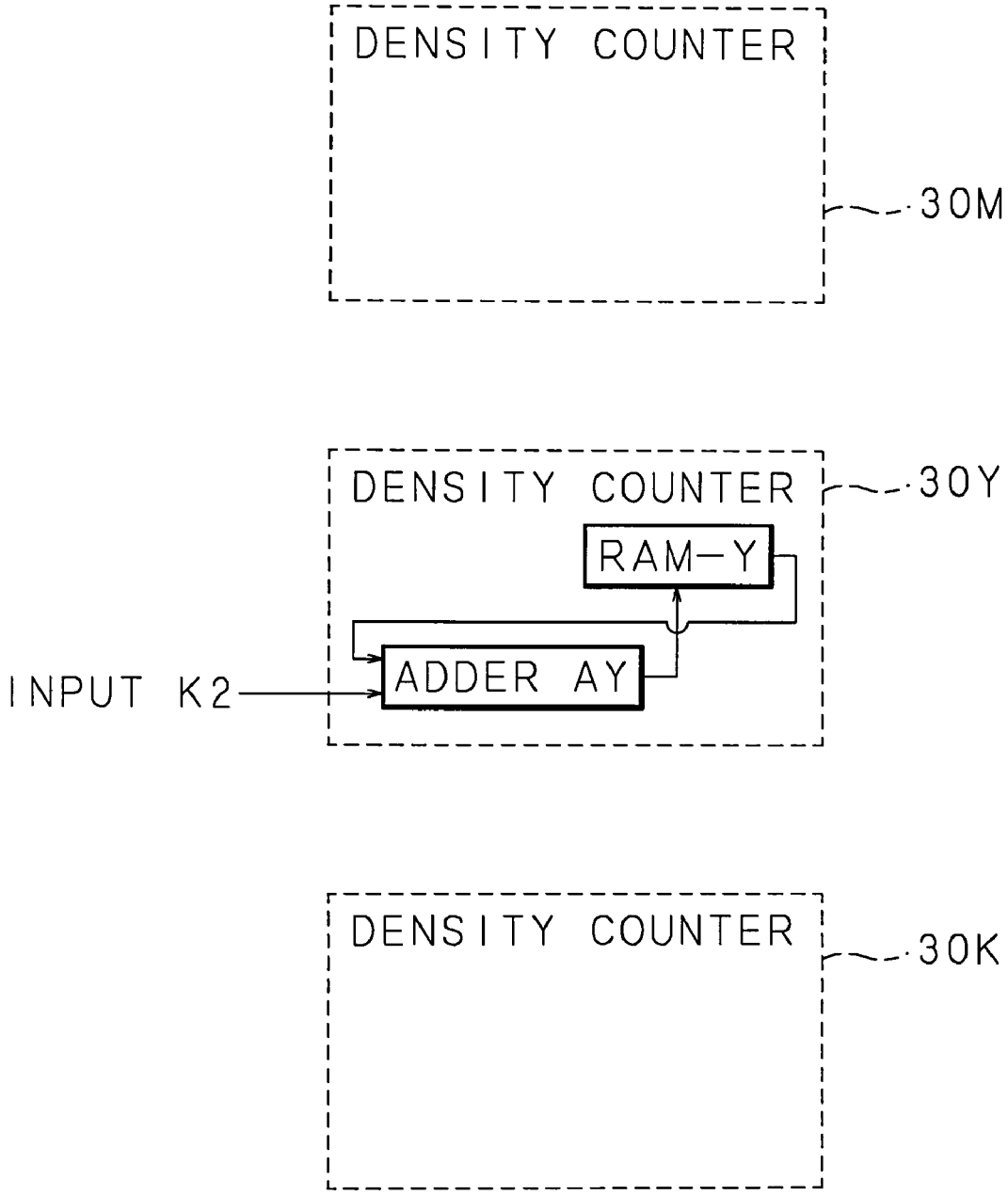
FIG. 18 is a view showing conceptually the operation of a density counter when the pixel values of the color components K1 and K2 of a black and white image are totaled.
Figure 19:
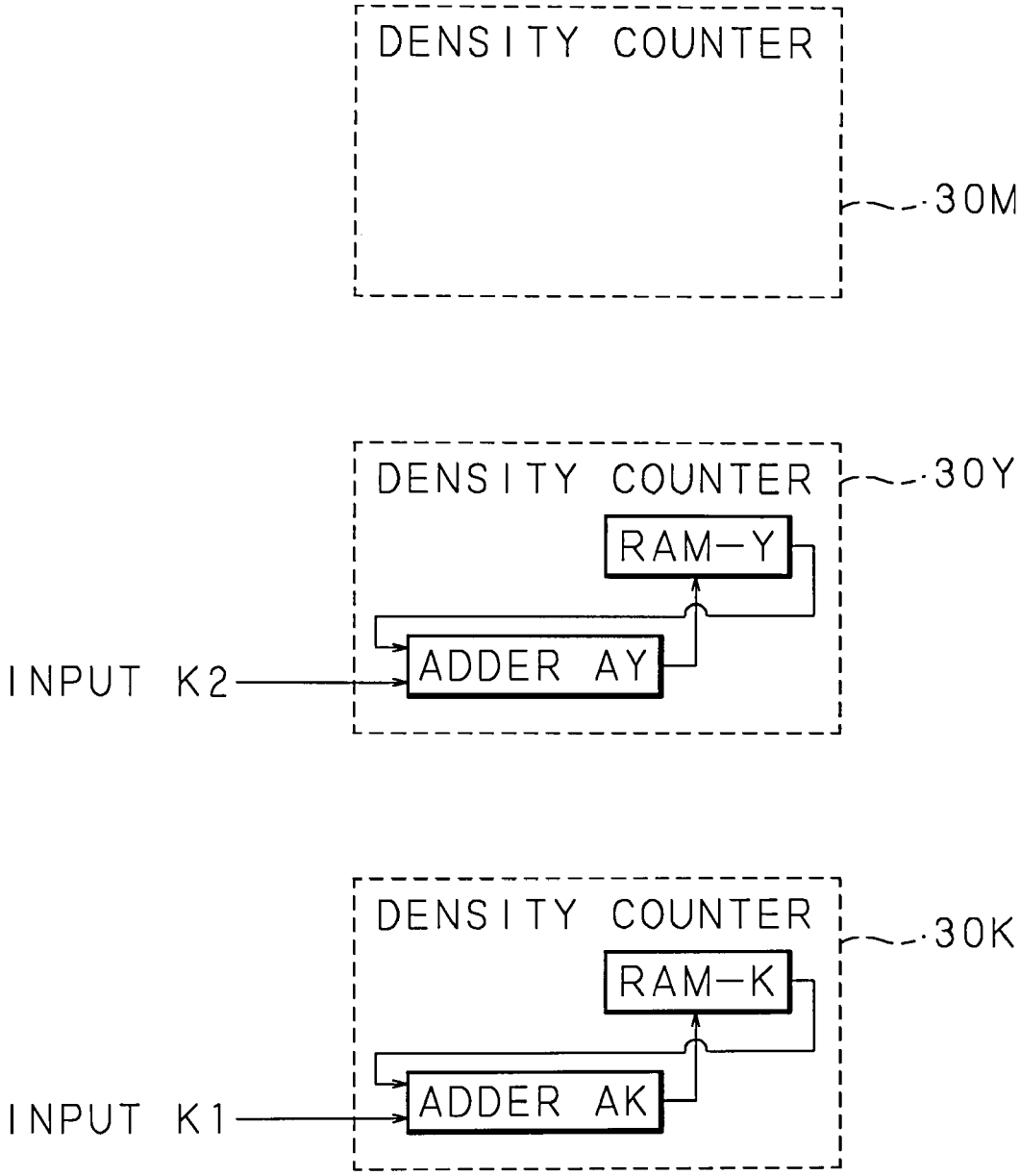
FIG. 19 is a view showing conceptually the operation of a density counter when the pixel values of the color components K1 and K2 of a black and white image are totaled.
Figure 20:
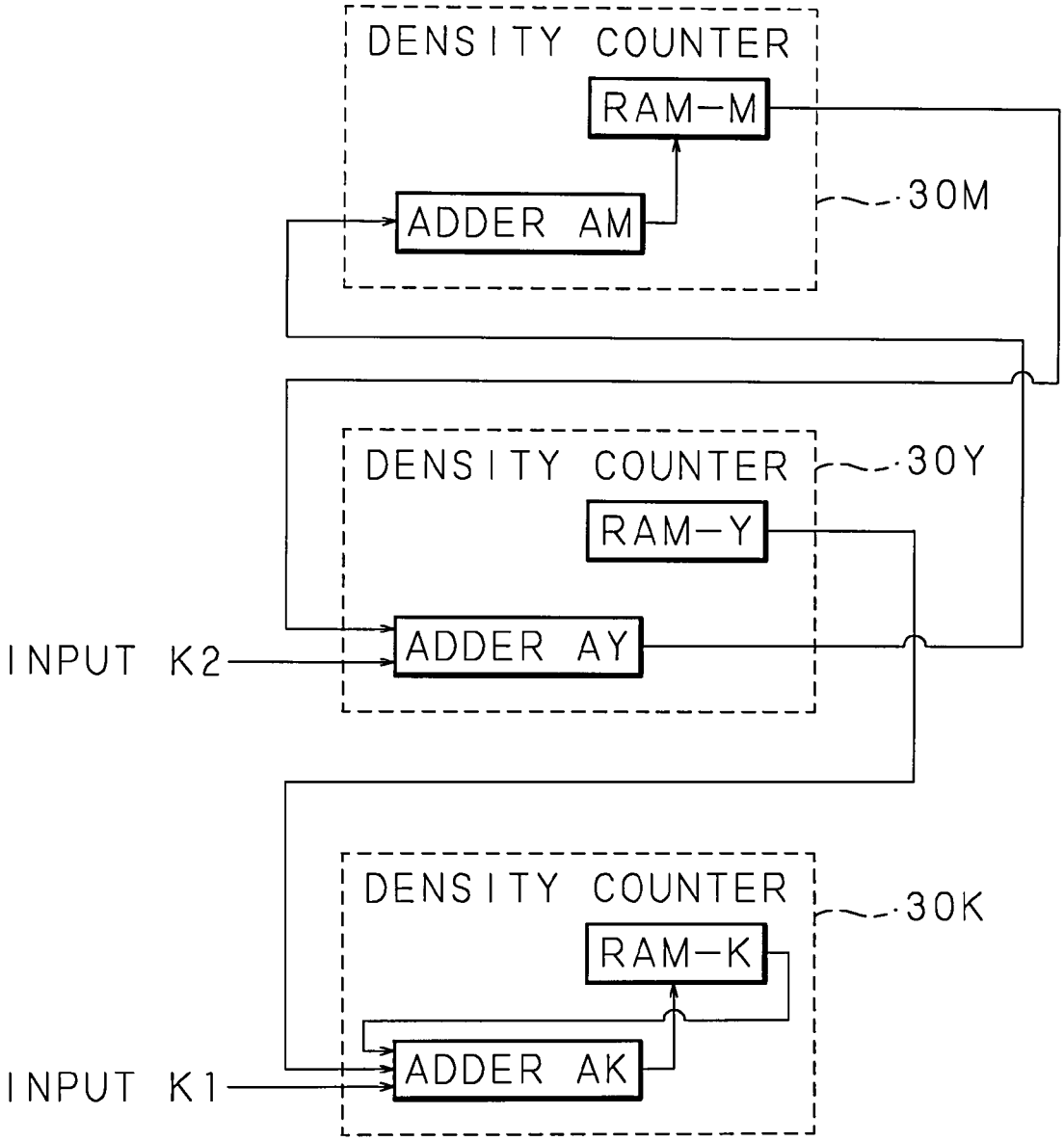
FIG. 20 is a view showing conceptually the operation of a density counter when the pixel values of the color components K1 and K2 of a black and white image are totaled.
Figure 23A:
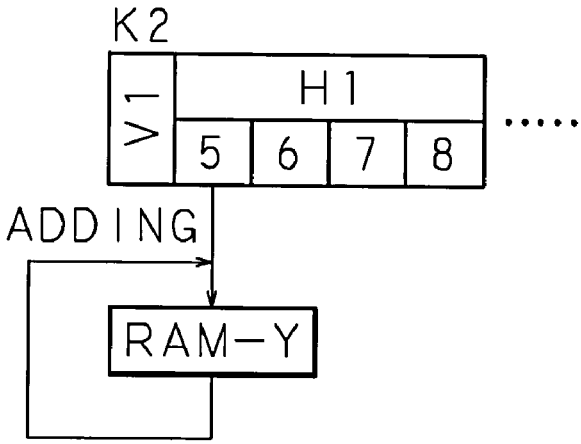
FIG. 23A and FIG. 23B are views showing conceptually the operation of a density counter when the pixel values of the color components K1 and K2 of a black and white image are totaled.
Figure 23B:
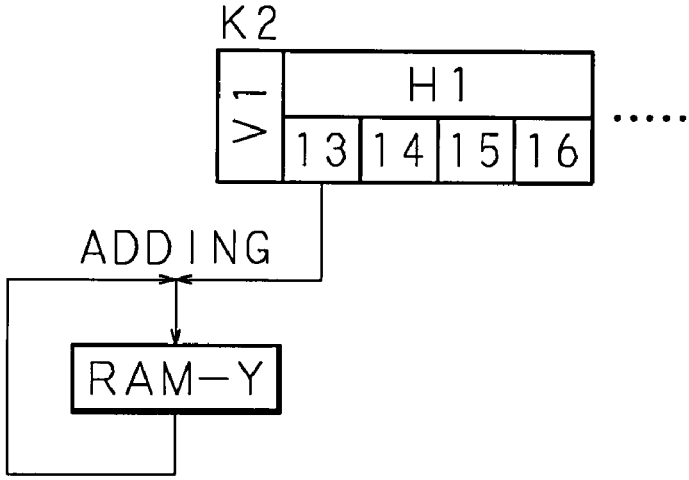
Figure 23B:
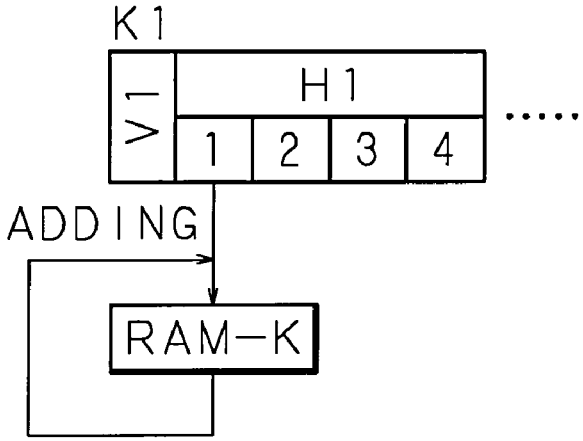
Figure 24A:
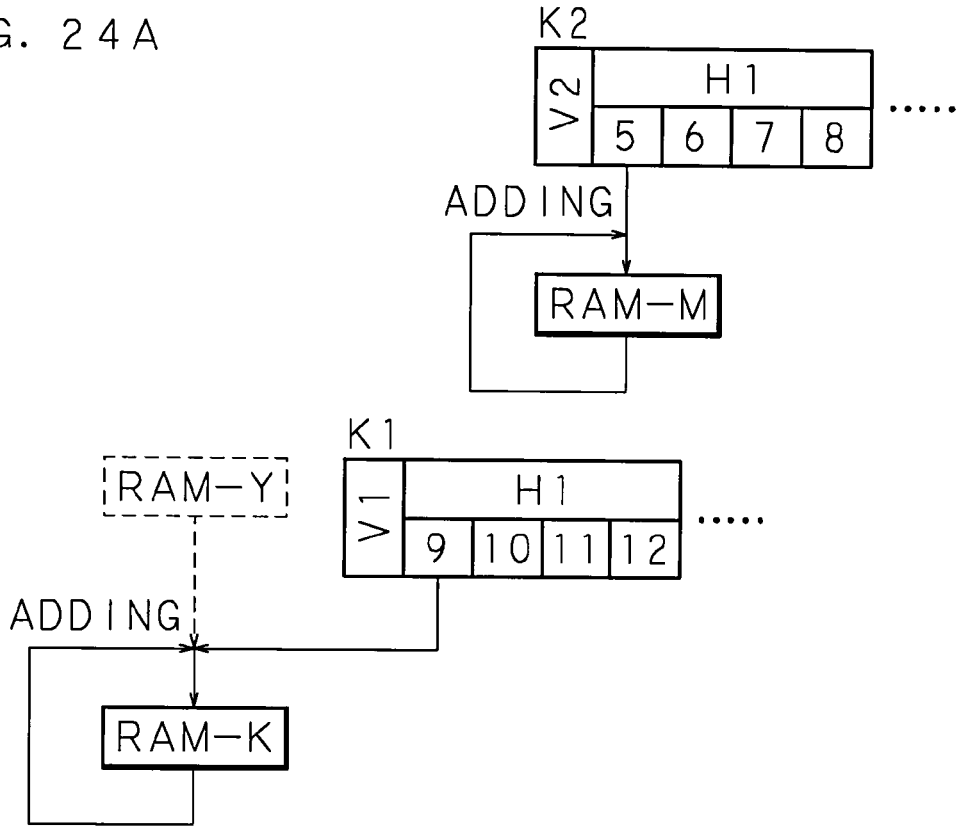
FIG. 24A and FIG. 24B are views showing conceptually the operation of a density counter when the pixel values of the color components K1 and K2 of a black and white image are totaled.

Regarding one line at the starting of input, as shown in FIG. 18 and FIG. 23A, the pixel values of the input K2 are totaled by the density counter 30Y. Regarding the next two lines, as shown in FIG. 19 and FIG. 23B, the pixel values of the input K2 are totaled by the density counter 30Y, while the pixel values of the input K1 are totaled by the density counter 30K. Regarding the next two lines, by controlling of the CPU 10, the selection unit 40M of the density counter 30M selects the adder AY output, the selection unit 40Y of the density counter 30Y selects the RAM-M output, and the selection unit 40K of the density counter 30K selects the RAM-Y output. Hereby, as shown in FIG. 20 and FIG. 24A, the pixel values of the input K2 are totaled by the density counter 30Y, and the cumulative value is stored in the RAM-M of the density counter M. Also, the pixel values of the input K1 are totaled by the density counter 30K. As a result of totaling by the density counter 30K, the cumulative value of the pixel value of the entire pixels (1 to 16) in the H1-V1 pixel block shown in FIG. 6 is obtained. Therefore, a value after being weighted can be obtained by inputting the cumulative value to the weighting circuit 37.

Figure 21:
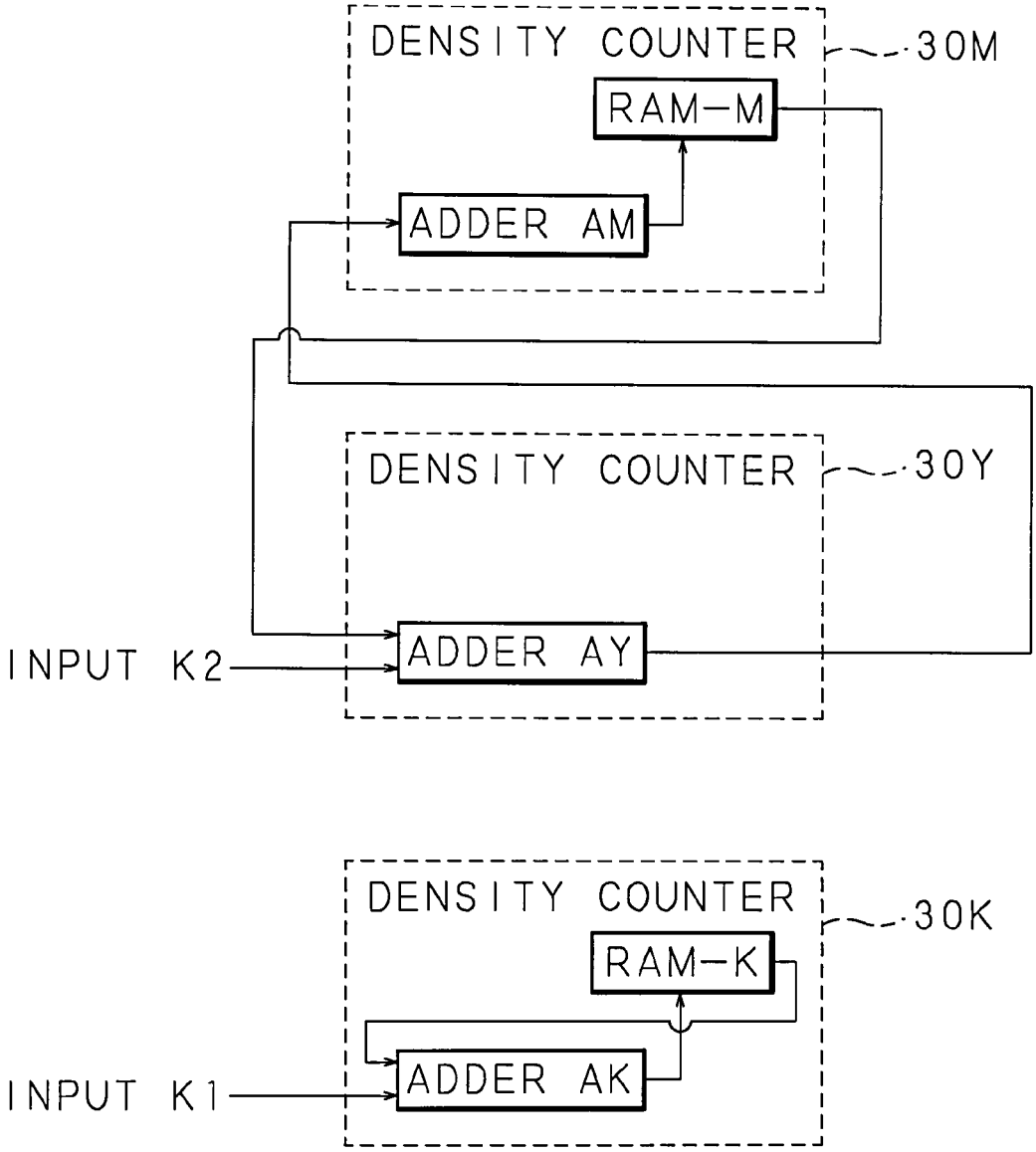
FIG. 21 is a view showing conceptually the operation of a density counter when the pixel values of the color components K1 and K2 of a black and white image are totaled.
Figure 22:
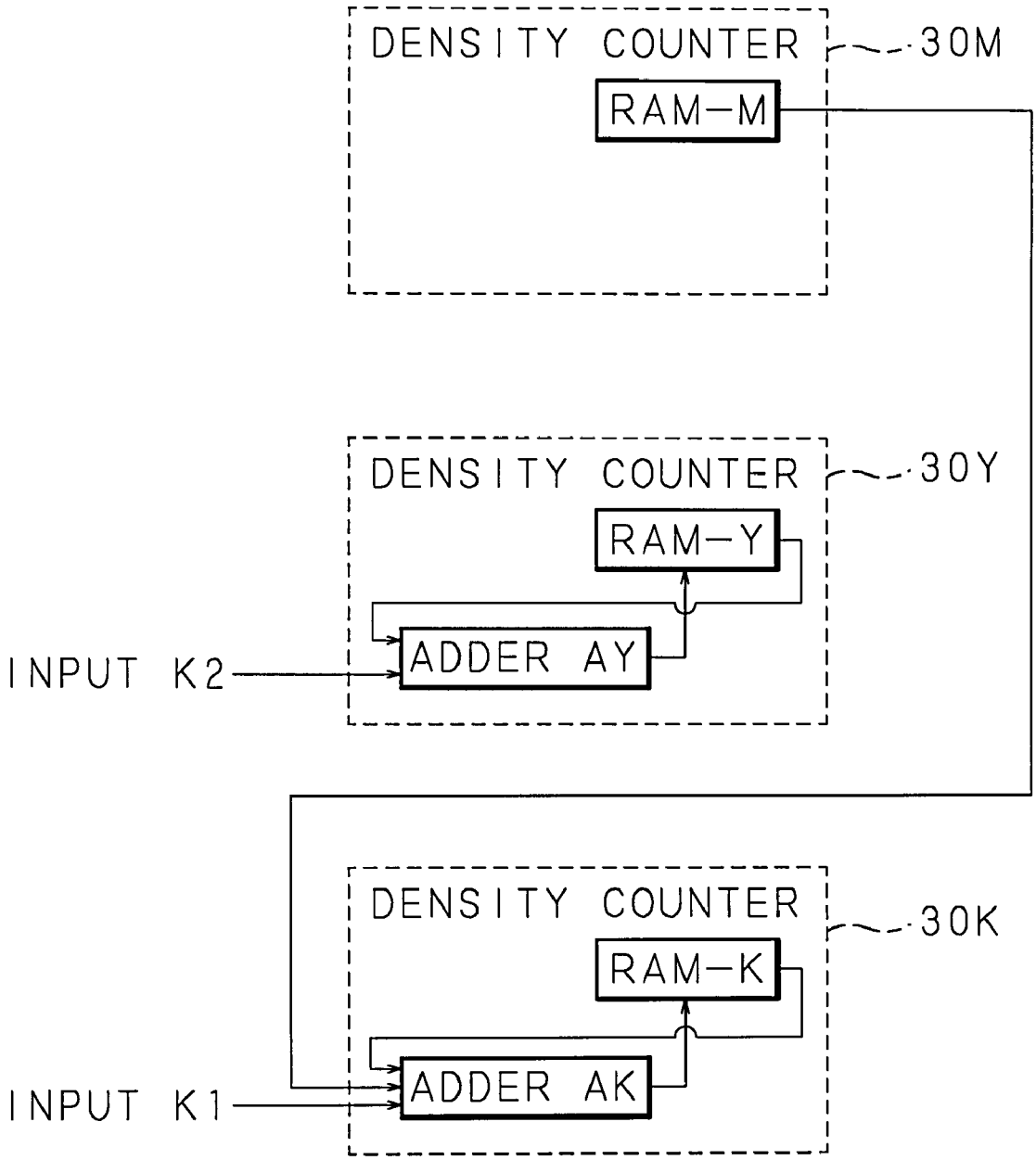
FIG. 22 is a view showing conceptually the operation of a density counter when the pixel values of the color components K1 and K2 of a black and white image are totaled.
Figure 24B:
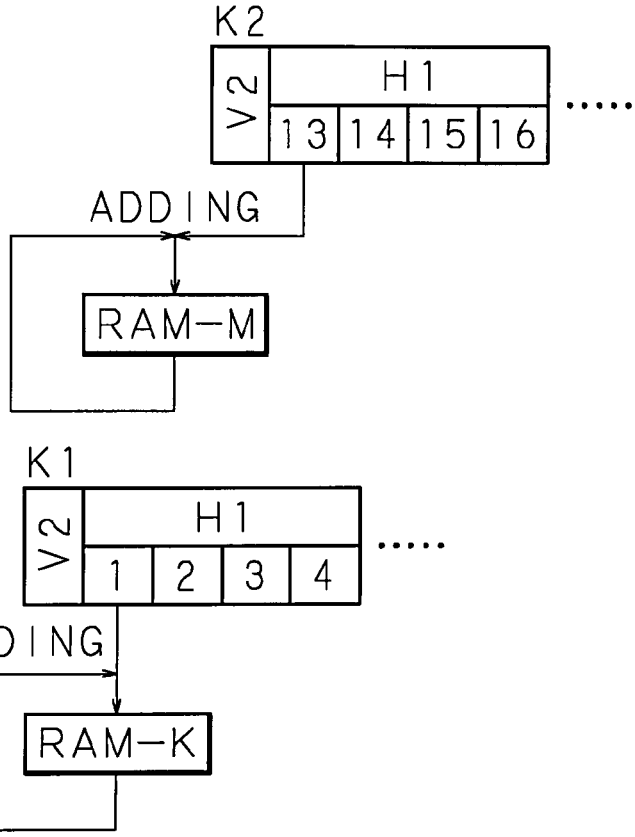
Figure 25:
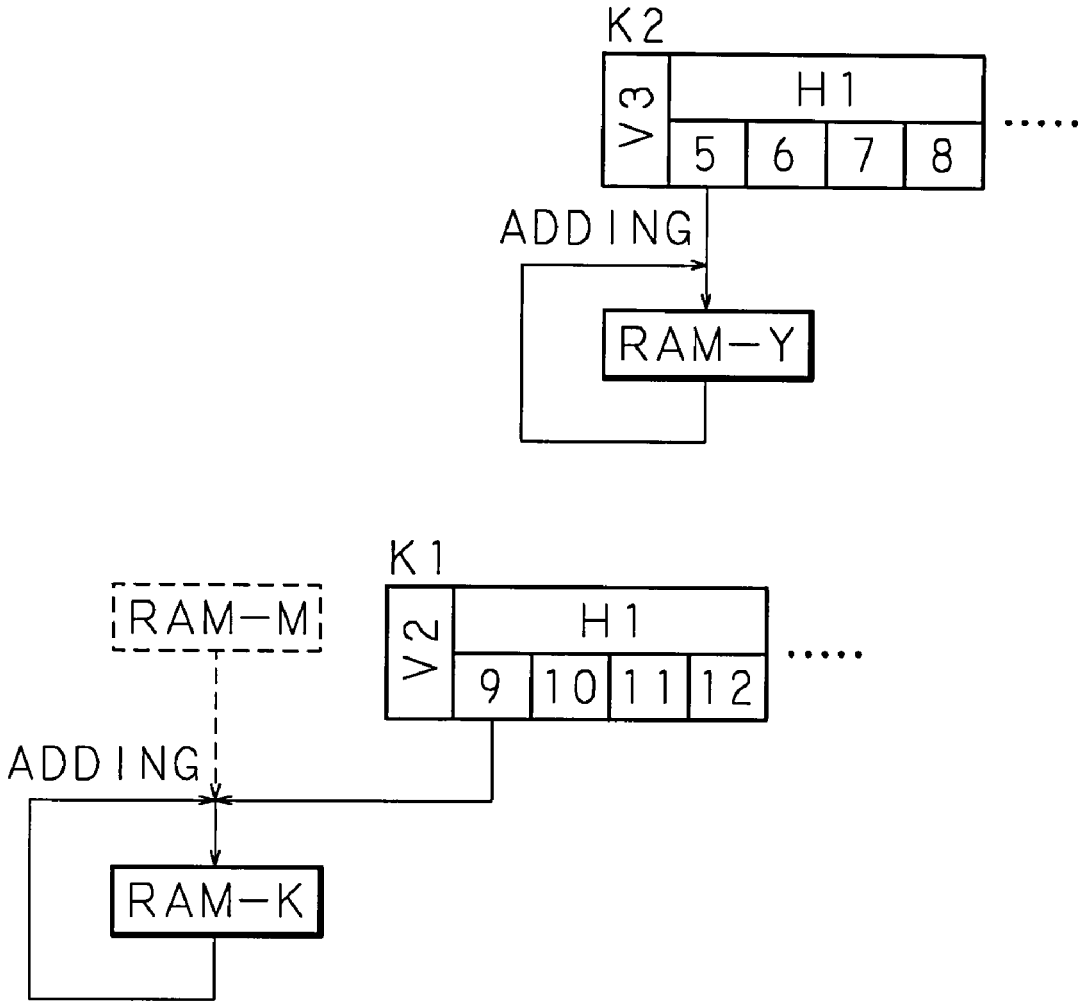
FIG. 25 is a view showing conceptually the operation of a density counter when the pixel values of the color components K1 and K2 of a black and white image are totaled.

Regarding the next two lines, by controlling of the CPU 10, the selection unit 40M of the density counter 30M selects the adder AY output, and the selection unit 40Y of the density counter 30Y selects the RAM-M output. Hereby, as shown in FIG. 21 and FIG. 24B, the pixel values of the input K2 are totaled by the density counter 30Y, and the cumulative value is stored in the RAM-M of the density counter M. Also, the pixel values of the input K1 are totaled by the density counter 30K. Regarding the next two lines, by controlling of the CPU 10, the selection unit 40K of the density counter 30K selects the RAM-M output. Hereby, as shown in FIG. 22 and FIG. 25, the pixel values of the input K2 are totaled by the density counter 30Y. Also, the pixel values of the input K1 are totaled by the density counter 30K. As a result of totaling by the density counter 30K, the cumulative value of the pixel value of the entire pixels (1 to 16) in the H1-V2 pixel block is obtained. Therefore, a value after being weighted can be obtained by inputting the cumulative value to the weighting circuit 37.

In this manner, in the image forming apparatus in accordance with the present invention, the cumulative value is obtained in units of a block of four pixels×four pixels, and thus, a correction can be performed in units of a block by the weighting circuit 37.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus for forming on a photosensitive member a monochromatic image or a color image represented by a plurality of color components, comprising:

first totaling means for totaling pixel values of monochromatic component of each pixel of an image formed on said photosensitive member when a monochromatic image is formed on said photosensitive member;

second totaling means for totaling pixel values of monochromatic component of each pixel of an image formed on said photosensitive member when a monochromatic image is formed on said photosensitive member, and totaling pixel values of predetermined color component of each pixel of an image formed on said photosensitive member when a color image is formed on said photosensitive member; and a first monochrome forming means for forming odd number lines of a monochromatic image on said photosensitive member; and a second monochrome forming means for forming even number lines of the monochromatic image on said photosensitive member;

wherein when a monochromatic image is formed on said photosensitive member, said first totaling means totals pixel values of monochromatic component of each pixel of the image formed on said photosensitive member by one of said first monochrome forming means and said second monochrome forming means, while said second totaling means totals pixel values of monochromatic components of each pixel of an image formed on said photosensitive member by the other of said first monochrome forming means and said second monochrome forming means.

2. The image forming apparatus as set forth in claim 1, further comprising third totaling means for totaling pixel values of respective color components other than said predetermined color component of each pixel of an image formed on said photosensitive member when a color image is formed on said photosensitive member.

3. The image forming apparatus as set forth in claim 2, wherein each of said first, second and third totaling means includes: a storage unit for storing cumulative value of pixel values; and adding means for adding the pixel values of corresponding color component of the image formed on said photosensitive member to the cumulative value stored in said storage unit; and toner consumption calculating means for calculating the toner consumption for each color component based on the cumulative value stored in said storage unit is provided.

4. The image forming apparatus as set forth in claim 3, further comprising:

saving means for saving the cumulative value stored in said storage unit of said second totaling means when an image formed on said photosensitive member is switched from a monochromatic image to a color image, or conversely switched from a color image to a monochromatic image; and resetting means for resetting the cumulative value stored in said storage unit of said second totaling means to zero after said saving means has completed the saving of the cumulative value stored in said storage unit of said second totaling means.

5. The image forming apparatus as set forth in claim 4, wherein when a monochromatic image is formed on said photosensitive member, said adding means of said first totaling means adds the cumulative value totaled by said second totaling means to the cumulative value totaled by said first totaling means, and stores the added result in said storage unit of said first totaling means.

6. The image forming apparatus as set forth in claim 3, wherein said first totaling means or said second totaling means includes a buffer memory for adjusting the output timing of pixel values to said adding means such that the addition timing of said adding means of said first totaling means and the addition timing of said adding means of said second totaling means are coincident with each other when a monochromatic image is formed.

7. The image forming apparatus as set forth in claim 6, wherein said storage unit of said third totaling means is used as said buffer memory when a monochromatic image is formed on said photosensitive member.

8. The image forming apparatus as set forth in claim 7, further comprising:

saving means for saving the cumulative value stored in said storage unit of said second totaling means when an image formed on said photosensitive member is switched from a monochromatic image to a color image, or conversely switched from a color image to a monochromatic image; and resetting means for resetting the cumulative value stored in said storage unit of said second totaling means to zero after said saving means has completed the saving of the cumulative value stored in said storage unit of said second totaling means.

9. The image forming apparatus as set forth in claim 8, wherein when a monochromatic image is formed on said photosensitive member, said adding means of said first totaling means adds the cumulative value totaled by said second totaling means to the cumulative value totaled by said first totaling means, and stores the added result in said storage unit of said first totaling means.

* * * * *